US005180659A

United States Patent [19]

Murai et al.

[11] Patent Number: 5,180,659

[45] Date of Patent: Jan. 19, 1993

[54] PHOTOSENSITIVE SILVER HALIDE PHOTOGRAPHIC MATERIAL

[75] Inventors: Kazuhiro Murai; Shun Takada, both of Odawara, Japan

[73] Assignee: Konica Corporation, Tokyo, Japan

[21] Appl. No.: 735,183

[22] Filed: Jul. 23, 1991

Related U.S. Application Data

[63] Continuation of Ser. No. 302,790, Jan. 26, 1989, abandoned.

[30] Foreign Application Priority Data

Jan. 30, 1988 [JP] Japan ..... 63-20373

[51] Int. Cl.[5] ..... G06C 1/30; G06C 1/34

[52] U.S. Cl. ..... 430/623; 430/626; 430/611; 430/615; 430/522; 430/550; 430/551

[58] Field of Search ..... 430/626, 611, 615, 522, 430/550, 551, 623

[56] References Cited

U.S. PATENT DOCUMENTS 4,839,263 6/1989 Miyoshi et al. ..... 430/384

4,839,270 6/1989 Kojima et al. ..... 430/583

FOREIGN PATENT DOCUMENTS 221747 11/1985 Japan .

250438 10/1987 Japan .

*Primary Examiner*—Charles L. Bowers, Jr.

*Assistant Examiner*—Thorl Chea

*Attorney, Agent, or Firm*—Jordan B. Bierman

[57] ABSTRACT

A photosensitive silver halide photographic material having a support and provided thereon, photographic component layers including at least one silver halide emulsion layer is disclosed. At least one silver halide emulsion layer comprises silver halide grains having silver chloride content of not less than 90 mol %; at least one of the photographic component layers comprises a specific dye excellent in decolorization and capable of improving sharpness; at least one silver halide emulsion layer comprises a mercapto compound for improving aging stability of silver halide emulsions; a photographic component layer is hardened with cyanuric chloride series hardeners for improving fog.

30 Claims, No Drawings

PHOTOSENSITIVE SILVER HALIDE PHOTOGRAPHIC MATERIAL

This application is a continuation of application Ser. No. 07/302,790, filed Jan. 26, 1989, now abandoned.

FIELD OF THE INVENTION

The present invention relates to a photosensitive silver halide photographic material suitable for rapid processing and, more particularly, to a silver halide photographic light-sensitive material which comprises good decolorization of dye, provides high image quality, and can be manufactured stably.

BACKGROUND OF THE INVENTION

Recently, in the art there have been needs for photosensitive silver halide photographic materials which provide high image quality, have good processing stability, and are available at low cost, and more particularly for those which enable to be rapidly processed.

Development of a photosensitive silver halide photographic material is usually carried out by continuously processing the photographic material with an automatic processing machine installed at a processing laboratory. Recently, however, more improved service for clients requires delivery of processed photographs on the same day as receiving unprocessed ones at photo shops. More recently, it has been escalated even to the extent that processed photographs are delivered within several hours after acceptance. Thus, there are now growing need for more rapid processing. Further, reduction of processing time leads to increased production efficiency and enables to reduce production cost, which justifies necessity for more rapid processing.

Hitherto, there have been studied more rapid processing from two aspects, namely, photosensitive material and processing solution. In color development, various attempts have been made which include processing at a higher temperature, higher pH and higher concentration of a color developing agent. It has also been known to use such additives as a development accelerator. The development accelerators include 1-phenyl-3-pyrazolidone specified in British Patent No. 811,185, N-methyl-p-aminophenol specified in British Patent No. 2,417,514, and N,N,N',N'-tetramethyl-p-phenylenediamine, specified in Japanese Patent Laid Open Publication No. 50 TM 15554. However, these methods can achieve no satisfactory rapid processing and often involve performance degradation such as increased fog.

Meanwhile, it is known that configuration, size and composition of silver halide grains affect development speed, and that especially, halogen composition is an influential factor and silver halide containing more chloride can accelerate development speed to a remarkably large extent.

In order to absorb ray of a particular wavelength for purposes of filtration, antihalation, prevention of irradiation and adjustment of emulsion sensitivity, a hydrophilic colloidal layer is colored with a dye.

It is also well known to prevent halation and/or irradiation in order to improve sharpness.

Dyes used for such purposes are required to provide such various properties as; satisfactory spectral absorption characteristics to meet applications; complete decolorization in a processing solution; easy elusion from a photographic material; no possibility to cause stain by residual color after development; no adverse effect such as fog or desensitization on a photographic emulsion; further, excellent aging stability in a photographic material and no discoloration or fading.

So far, many efforts have been made in order to find out dyes which can provide the foregoing properties, and many dyes have been proposed as such. Such dyes include, for example, oxonol dyes described in U.S. Pat. No. 506,385 and 3,247,127, and in Japanese Patent Publication No. 39-22069 and 43-13168; styryl dyes represented by U.S. Pat. No. 1,845,404; melocyanine dyes represented by U.S. Pat. No. 2,493,747, 3,148,187, and U.S. Pat. No. 3,282,699; cyanine dyes represented by U.S. Pat. No. 2,843,486; and anthraquinone dyes represented by U.S. Pat. No. 2,865,752.

The present inventors have examined various dyes in order to find out dyes having specific chemical structures, which are suitable for rapid processing in combination with silver halide having higher content of chloride enabling to accelerate development speed, and provide particularly good decolorization performance even in rapid processing. As a result, it has been discovered that the dyes having specific chemical structures can meet this object.

However, a combination of the preceding silver halide emulsion having a high silver chloride content and a dye having a specific chemical structure are liable to increase fog, and especially in silver halide emulsion having higher silver chloride content, this tendency is more remarkable.

In this connection, however, reference is made to Japanese Patent Laid Open Publication No. 60-221747 in which it is stated that an emulsion layer of a silver halide photographic material having a preceding constitution, which is hardened with a chlorotriazine hardener, can be inhibited in fogging.

Meanwhile, in producing a photosensitive silver halide photographic material comprising a combination of preceding silver halide with high content of chloride having excellent properties and a dye having a specific chemical structure, of which emulsion layer is hardened with a chlorotriazine hardener, there is found notable difference in sensitivity and gradation of a silver halide emulsion layer between coating of a silver halide photographic emulsion coating solution (hereinafter referred to as coating solution) on a support just after preparation and after aging at regular temperature. This poor aging stability at regular temperature creates a serious problem that it is difficult to mass-produce a photographic material of uniform quality.

Apparently, this is a problem inherent to silver halide emulsions having a high silver chloride content, and in addition, it may be also attributable to the fact that a dye having a specific chemical structure contained in photographic component layers affects performance of an emulsion in a coating solution which has been aged at regular temperature.

The above mentioned phenomenon is especially noticeable in the case where the preceding dye is added to a silver halide emulsion layer, but it is noted that the dye added to a non-photosensitive layer can affect adversely by diffusion between individual photographic component layers.

It is assumed that such phenomenon is also the case with a chlorotriazine hardener, though less noticeable.

Then, in order to improve aging stability of a coating solution at regular temperature, a method of adding a sensitizing dye to a coating solution was considered. This method is good approach for improvement of aging stability of the coating solution, but involves a problem of very frequent appearance of residual color stains due to the sensitizing dye.

As another technique for improvement of aging stability of a coating solution at regular temperature, a combination of a particular coupler and a particular sensitizing dye is disclosed in Japanese Patent Laid Open Publication No. 59-166955. This method was tested in combination of a silver halide emulsion having a high silver chloride content, a highly decolorant dye and a chlorotriazine hardener, but no sufficient effect was observed against gradation fluctuation, though the method proved to be effective for improving sensitivity fluctuation.

Thus, after all, tests with the known techniques were unsuccessful in obtaining any photosensitive silver halide photographic material which could meet the requirements for high image quality in rapid processing and good aging stability of a coating solution.

SUMMARY OF THE INVENTION

Accordingly, it is a primary object of the present invention to provide a photosensitive silver halide photographic material which is well adapted for rapid processing, provides excellent decolorization of a dye and high image quality, and can be steadily mass-produced because of excellent aging stability of a coating solution.

DETAILED DESCRIPTION OF THE INVENTION

The foregoing object of the invention can be accomplished by a photosensitive silver halide photographic material having photographic component layers including at least one silver halide emulsion layer on a support, wherein said at least one silver halide emulsion layer contains silver halide grains with a silver chloride content of not less than 90 mol %; at least one of said photographic component layers contains a compound represented by the following Formula [I]; said at least one silver halide layer contains a compound represented by the following Formula [II]; and an emulsion layer is hardened with compounds represented by the following Formula [III] and/or Formula [IV];

Formula [I]

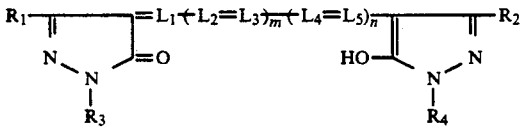

wherein $R_1$ and $R_2$ represent independently —CN, —$CFR_5R_6$, —$COR_7$, or $CONHR_8$; $R_5$ and $R_6$ represent independently a hydrogen atom, a fluorine atom, or a fluoroalkyl group having 1 to 4 carbon atoms; $R_7$ represents an alkyl or an aryl group; $R_8$ represents a hydrogen atom, a halogen atom, an alkyl group, or a fluoroalkyl group; $R_3$ and $R_4$ represent independently a hydrogen atom, an aliphatic group, an alicyclic group, an aramatic group or a heterocyclic group; $L_1$ to $L_5$ represent a methine group; and m and n represent independently 0 and 1;

Formula [II]

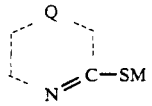

wherein Q represents a group of atoms necessary to form a 5- or 6-membered heterocyclic ring including one condensed with a benzene and M represents a hydrogen atom or a cation.

Formula [III]

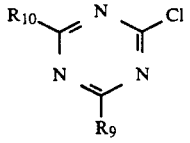

wherein $R_9$ and $R_{10}$ represent independently a chlorine atom, a hydroxyl group, an alkyl group, an alkoxy group, an alkylthio group, —OM' (where M' is a monovalent metallic atom), —$NR_{11}R_{12}$ (where $R_{11}$ and $R_{12}$ are a hydrogen atom, an alkyl group, and an aryl group), and —$NHCOR_{13}$ (where $R_{13}$ is a hydrogen atom, an alkyl group or an aryl group), provided that one of $R_9$ and $R_{10}$ represents a group other than a chlorine atom.

Formula [IV]

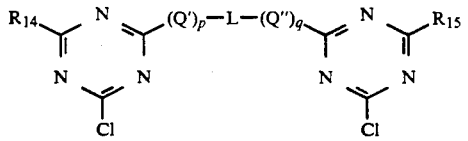

wherein $R_{14}$ and $R_{15}$ represent independently a chlorine atom, a hydroxyl group, an alkyl group, an alkoxy group and —OM' (where M' is a monovalent metallic atom); Q' and Q'' represent independently —O—, —S— and —NH—; L represents an alkylene group or an arylene group; and p and q represent independently 0 and 1.

In the present invention, at least one of the silver halide layers contains silver halide grains having a silver chloride content of not less than 90 mol %, preferably not less than 95 mol %. A silver bromide content in a silver halide grain is preferably not more than 5 mol % and not less than 0.05 mol %, and a silver iodide content therein is preferably not more than 0.5 mol %.

The silver halide grain relating to the invention may be used either in a single composition or in mixture of silver halide grains of different compositions. It may be used in mixture with silver halide grains having a silver chloride content of not more than 10 mol %.

In a silver halide emulsion layer containing silver halide grains with a silver chloride content of not less than 90 mol % relating to the invention, the proportion of the silver halide grains with a silver chloride content of 90 mol % to the all silver halide grains contained in the emulsion layer is not less than 60% by weight, preferably not less than 80% by weight.

The inner composition of the silver halide grains relating to the invention may be uniform or ununiform, and it may vary continuously or discontinuously.

A size of the silver halide grain in the invention is not particularly limited, but from the viewpoint of rapid processability, sensitivity and other photographic properties, it is preferably at the range of to 1.6 μm, more preferably 0.25 to 1.2 μm. A grain size can be measured by various methods conventionally used in the art. The typical methods are described in Loverland's "Method of Particle Size Analysis" (A. S. T. M. Symposium on Light Microscopy, 1955, pp 94–122), and "Theory of Photographic Process" (collaborated by Miese and James, 3rd ed., Chap. 2, published by The Macmillan Press Ltd. (1966)).

A grain size can be obtained by measuring projected area or approximate diameter of the grain. If a grain is of a substantially uniform size, grain size distribution can be calculated fairly accurately by diameter or projected area.

The grain size distribution of the silver halide gains in the invention may be polydispersed or monodispersed. Preferably, the silver halide grains are monodispersed. Preferably, the silver halide grains are monodispersed grains of which variation coefficient in a grain size distribution is not more than 0.22, more preferably not more than 0.15. Variation coefficient represents a coefficient indicating width of a grain size distribution, and is defined by the following equation;

$$\text{Variation coefficient } (S/\bar{r}) = \frac{\text{Standard deviation of grain size}}{\text{Average grain size}}$$

$$\text{Standard deviation of grain size } (S) = \sqrt{\frac{\Sigma(\bar{r} - ri)^2 ni}{\Sigma ni}}$$

$$\text{Average grain size } (\bar{r}) = \frac{\Sigma niri}{\Sigma ni}$$

wherein ri denotes diameter of individual grains, and ni denotes the number of grains.

A grain size herein refers to a diameter of a silver halide grain in case of a spherical grain, and in case of non-spherical grain such as a cube, it refers to a diameter of a circle having the same area as a projected image of the grain.

The silver halide grains used for the emulsion of the invention may be prepared by an acid method, a neutral method, or an ammonia method. The grains may be grown at one time, or may be grown after seed grains are prepared. The methods for preparing of seed grains and growing grains may be identical or different.

The manners in which soluble silver salt and halogen salt react include regular mixing, reverse mixing, simultaneous mixing, and a combination of these mixing techniques, but simultaneous mixing is preferred. One form of simultaneous mixing is a pAg-controlled double jet method described in Japanese Patent Laid Open Publication No. 54-48521.

Further, if necessary, a silver halide solvent such as thioether may be used. It is also possible to add a mercapto compound other than that related to the invention, a nitrogen-containing heterocyclic compound, and a sensitizing dye during or after formation of silver halide grains. The silver halide grains used in the invention may be of any desired form. One preferred example is a cube having a crystal phase of (100) plane. It is possible to use the grains having such forms as octahedron, tetradecahedron, or dodecahedron, which can be prepared according to the methods described in U.S. Pat. Nos. 4,183,756 and 4,225,666, Japanese Patent Laid Open Publication No. 55-26589, Japanese Patent Publication No 55-42737, and other publications such as the Journal of Photographic Science, 21, 39 (1973). The grains having twinned planes may also be used. The silver halide graines of the invention may be of a single form or of a mixture of grains having various different forms.

The silver halide grains used in the emulsion of the invention may be incorporated with the metallic ions of cadmium salt, zinc salt, lead salt, thallium salt, iridium salt or complex salt, rhodium salt or complex salt, or iron salt or complex salt at a stage of forming and/or growing grains so that the metallic ions are included in and/or on surfaces of grains. Reduction of the grains also can provide a reduced sensitizing nucleus in and/or on surfaces of grains.

In an emulsion containing the silver halide grains of the invention (hereinafter referred to as the emulsion of the invention), unnecessary soluble salts remaining after completion of growth of silver halide grains may be removed, or may remain as they are. The salts can be removed according to the procedures described in Research Disclosure No. 17643.

The silver halide grains used in the emulsion of the invention may have latent images formed mainly on the surfaces or within the grains. Preferably, they have the latent images formed on the surfaces.

The emulsion of the invention is chemically sensitized by conventional methods. For this purpose, a sulfur sensitization method which uses sulfur compound capable of reacting with silver ions or an activated gelatin, a selenium sensitization method using a selenium compound, a reduction sensitization method using a reducing substance, or a noble metal sensitization method using gold and other noble metals may be employed either alone or in combination.

In the present invention, a chemical sensitizer, for example, chalcogenide sensitizer may be used. Chalcogenide sensitizer is a generic term for sulfur, selenium and tellurium sensitizers. For photographic use, sulfur and selenium sensitizers are preferred. The examples of sulfur sensitizer include thiosulfate, allyl thiocarbazide, thiourea, allylisocyanate, cystine, p-toluenethiosulfonate, and rhodanine. In addition to the above, may be used the sulfur sensitizers described in U.S. Pat. Nos. 1,574,994, 2,410,689, 2,278,947, 2,728,668, 3,501,313 and U.S. Pat. No. 3,656,955, German OLS No. 1,422,869, and Japanese Patent Laid Open Publication Nos. 56-4937 and 55-45016. An addition amount of a sulfur sensitizer may vary at a wide range according to various conditions such as pH, temperature and silver halide grain size, and a standard is preferably at a range of $10^{-7}$ mol to $10^{-1}$ mol per mol of silver halide.

The silver halide grains of the invention preferably contain a gold compound. The gold compounds useful in the invention may be either monovalent or trivalent, and various kinds of gold compounds may be used. Typical examples are potassium chloroaurate, auric trichloride, potassium auric thiocyanate, potassium iodoaurate, tetracyanoauric azide, ammonium aurothiocyanate, pyridyl trichlorogold, gold sulfide, and gold solenide. The gold compounds may be used in such a way as to sensitize the silver halide grains, or to have substantially no contribution to sensitization.

An addition amount of a gold compound may vary according to the conditions, and a standard is preferably at a range of $10^{-8}$ mol to $10^{-1}$ mol per mol of silver halide, and more preferably $10^{-7}$ to $10^{-2}$ mol. These compounds may be added at any stages of formation, physical and chemical aging, and post-chemical aging of silver halide grains.

The emulsion of the invention may be spectrally sensitized to any desired wave range by using dyes known in the art as sensitizing dyes. The sensitizing dyes may be used either alone or in combination of two or more kinds.

Compounds having no spectral sensitizing effect in itself or having capability of substantially absorbing no visible light and acting as a supersensitizer for intensifying a sensitizing action of the sensitizing dyes may be contained in the emulsion together with the sensitizing dyes.

Silver halide grains used for a silver halide emulsion layer having no relation to the invention is not particularly limited, but preferably they contain silver halide grains having the same silver chloride content of not less than 90 mol % as that of what is used for the silver halide emulsion layer of the invention.

In the photosensitive silver halide photographic material of the invention, at least one of the photographic component layers consisting of photosensitive layers including silver halide emulsion layers containing the silver halide grains of the invention and the other silver halide emulsion layers, and non-photosensitive layers including an intermediate layer, a protective layer, a filter layer and an anti-halation layer, contain a compound represented by Formula [I].

The compound represented by Formula [I] of the invention (hereinafter referred to as Compound [I] of the invention) will now be explained.

In Formula [I], $R_1$ and $R_2$ represent independently —CN, —$CFR_5R_6$, —$COR_7$ and $CONHR_8$, wherein $R_5$ and $R_6$ represent independently a hydrogen atom, a fluorine atom and a fluoroalkyl group having 1 to 4 carbon atoms. The examples of the fluoroalkyl group having 1 to 4 carbon atoms include a difluoromethyl group, a trifluoromethyl group, a 1,1,2,2-tetrafluoroethyl group, a 1,1,2,2,3,3,4,4-octafluorobutyl group, and a 1,1,2,2,3,3-hexafluoropropyl group.

$R_7$ represents an alkyl group or an aryl group including substituted one.

$R_3$ and $R_4$ represent independently a hydrogen atom, an aliphatic group, an alicyclic group, an aromatic group and a heterocyclic group; the aliphatic group is exemplified by alkyl and alkenyl groups, and the aliphatic group by a cycloalkyl group. The aromatic group is exemplified by an aryl group, e.g. phenyl and naphthyl groups, and the heterocyclic group by benzthiazolyl and benzozazolyl groups.

Said aliphatic, alicyclic, aromatic and heterocyclic groups represented by $R_3$ and $R_4$ include those having substituents.

A methine group represented by $L_1$ to $L_5$ includes one substituted with an alkyl group having 1 to 4 carbon atoms or an aryl group.

$R_1$ and $R_2$ are preferably a —CN group, a —$CF_3$ group, a —$CONH_2$ group and a —$COR_7$ group, wherein $R_7$ is preferably an alkyl group. $R_3$ and $R_4$ are preferably an aromatic group, more preferably a 4-sulfophenyl group, a 2,5-di-sulfophenly group and the salts thereof.

The dyes of the invention preferably have at least one hydrophilic group (e.g., a sulfo group, a carboxyl group and the salts thereof.

The typical examples of Compound [I] of the invention are shown below; it is to be understood, however, that the dyes of the invention are not limited to them.

Compound [I]

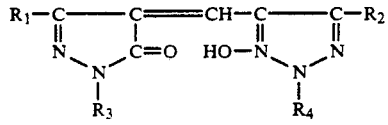

| No. | $R_1$ | $R_2$ | $R_3$ | $R_4$ |
|---|---|---|---|---|
| 1 | —CN | —CN | 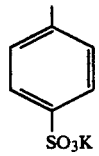 | 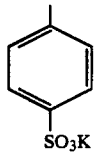 |
| 2 | —CN | —CN | 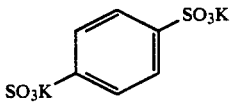 | 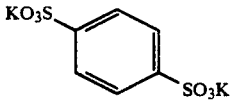 |
| 3 | —CN | —CN | 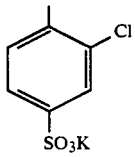 | 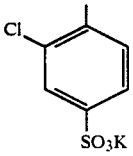 |

-continued
| | | | | |
|---|---|---|---|---|
| 4 | $-CF_3$ | $-CF_3$ | 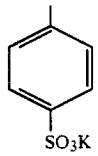 | 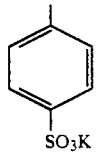 |
| 5 | $-COCH_3$ | $-COCH_3$ | 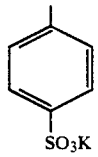 | 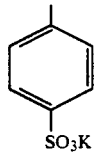 |
| 6 | $-COCH_3$ | $-COCH_3$ | 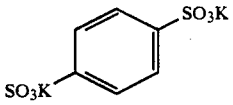 | 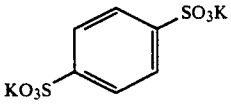 |
| 7 | $-COCH_3$ | $-CONH_2$ | 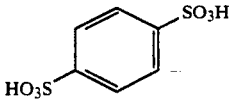 | 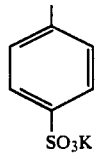 |
| 8 | $-CONHCF_3$ | $-CONHCF_3$ | 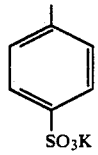 | 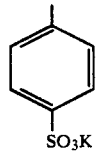 |
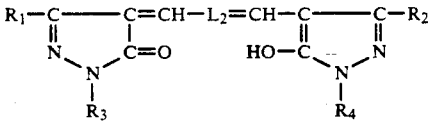
| No. | $R_1$ | $R_2$ | $L_2$ | $R_3$ | $R_4$ |
|---|---|---|---|---|---|
| 9 | $-CN$ | $-CN$ | $-CH=$ | 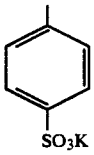 | 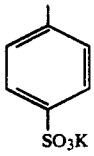 |
| 10 | $-CN$ | $-CN$ | $-CH=$ | 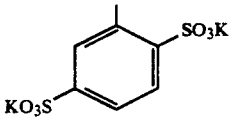 | 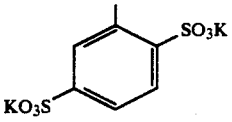 |
| 11 | $-CN$ | $-CN$ | $-CH=$ | 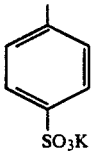 | 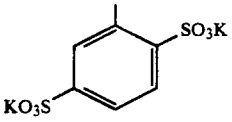 |
| 12 | $-CN$ | $-CN$ | $-CH=$ | 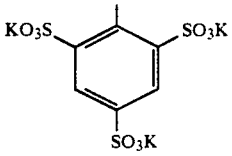 | 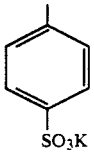 |

-continued
| | | | | | |
|---|---|---|---|---|---|
| 13 | —CN | —CN | —CH= | 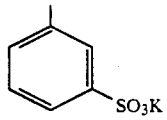 | 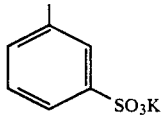 |
| 14 | —CN | —CN | —CH= | 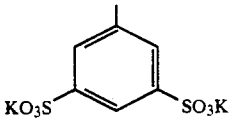 | 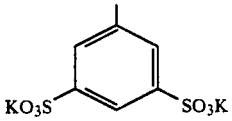 |
| 15 | —CN | —CN | —CH= | 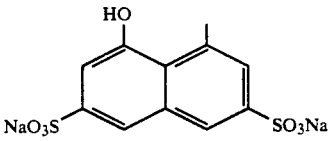 | 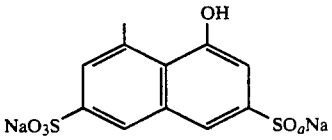 |
| 16 | —CN | —CN | $-\overset{C_2H_5}{\overset{\vert}{C}}=$ | 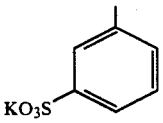 | 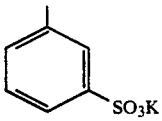 |
| 17 | —CN | —CN | —CH= | 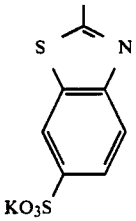 | 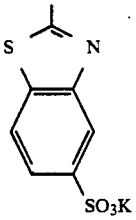 |
| 18 | $-CF_3$ | $-CF_3$ | —CH= | 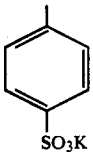 | 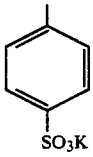 |
| 19 | $-CF_3$ | $-CF_3$ | —CH= | 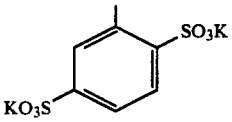 | 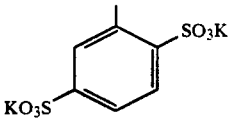 |
| 20 | $-CONH_2$ | $-CONH_2$ | —CH= | 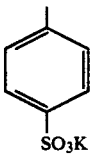 | 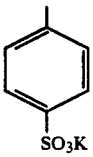 |
| 25′ | $-CONH_2$ | —CN | —CH= | 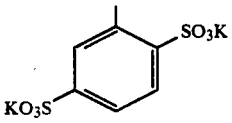 | 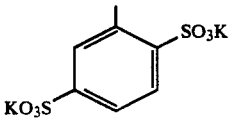 |
| 21 | $-CONH_2$ | $-CONH_2$ | —CH= | 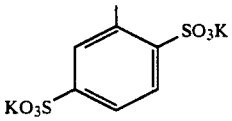 | 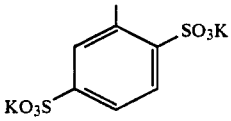 |

-continued
| | | | | | |
|---|---|---|---|---|---|
| 22 | $-CONH_2$ | $-CONH_2$ | $-CH=$ | 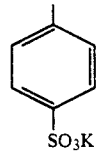 | 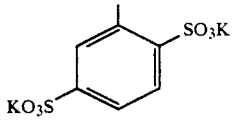 |
| 23 | $-CONH_2$ | $-CONH_2$ | $-\overset{CH_3}{\overset{\vert}{C}}=$ | 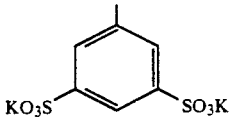 | 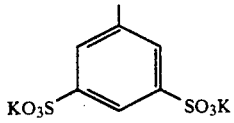 |
| 24 | $-CONH_2$ | $-CONH_2$ | $-CH=$ | 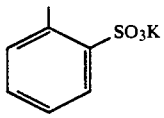 | 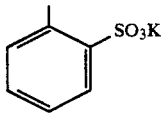 |
| 25 | $-CONH_2$ | $-CONH_2$ | $-CH=$ | 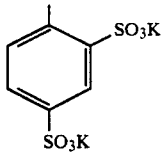 | 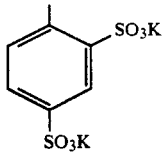 |
| 26 | $-CF_3$ | $-CF_3$ | $-CH=$ | 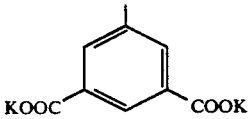 | 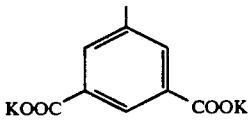 |
| 27 | $-CF_3$ | $-CF_3$ | $-CH=$ | 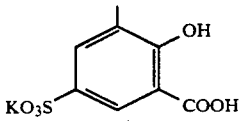 | 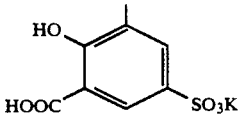 |
| 28 | $-CONH_2$ | $-CN$ | $-CH=$ | 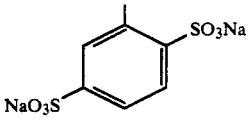 | 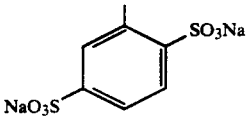 |
| 29 | $-(CF_2)_2H$ | $-(CF_2)_2H$ | $-CH=$ | 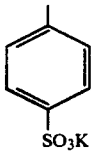 | 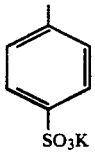 |
| 30 | $-(CF_2)_4H$ | $-(CF_2)_4H$ | $-CH=$ | 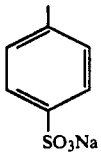 | 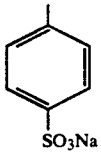 |
| 31 | $-CF_2H$ | $-CF_2H$ | $-CH=$ | 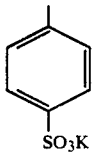 | 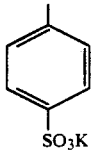 |

-continued
| | | | | | |
|---|---|---|---|---|---|
| 39′ | 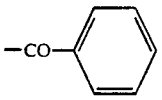 | $-CONH_2$ | $-CH=$ | 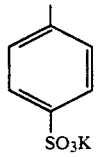 | 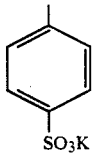 |
| 38′ | $-COCH_3$ | $-CF_3$ | $-CH=$ | 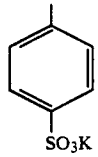 | 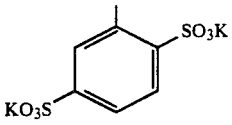 |
| 34 | $-COCH_3$ | $-COCH_3$ | $-CH=$ | 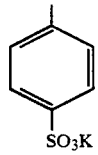 | 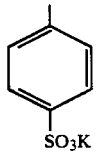 |
| 35 | $-COCH_3$ | $-COCH_3$ | $-CH=$ | 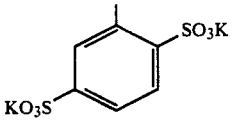 | 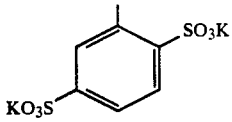 |
| 36 | $-COCH_3$ | $-COCH_3$ | $-\overset{C_2H_5}{\overset{\vert}{C}}=$ | 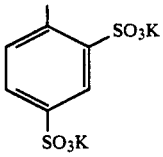 | 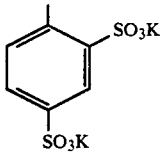 |
| 37 | $-COCH_3$ | $-COCH_3$ | $-CH=$ | 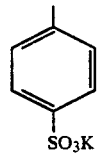 | 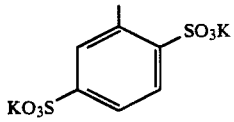 |
| 38 | $-COC_2H_5$ | $-COC_2H_5$ | $-CH=$ | 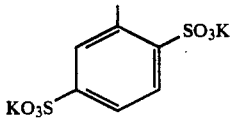 | 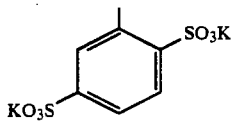 |
| 39 | 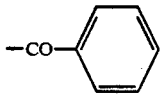 | 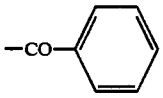 | $-CH=$ | 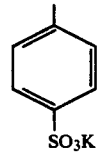 | 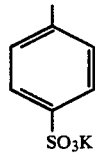 |
| 40 | $-(CF_2)_5H$ | $-(CF_2)_5H$ | $-CH=$ | 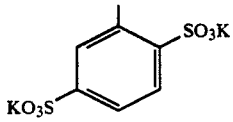 | 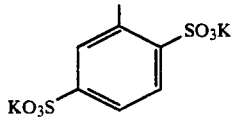 |
| 42 | $-CONH(CF_24H$ | $-CONH(CF_2)_4H$ | $-CH=$ | 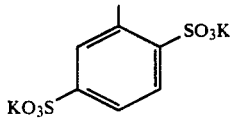 | 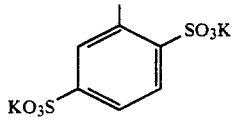 |

-continued
| | | | | | |
|---|---|---|---|---|---|
| 43 | $-COCH_3$ | $-COCH_3$ | $-CH=$ | 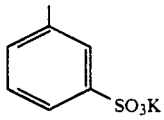 | 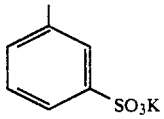 |
| 44 | $-COCH_3$ | $-COCH_3$ | $-C(C_2H_5)=$ | 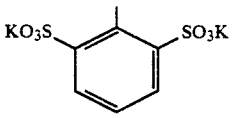 | 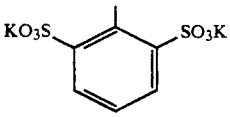 |
| 45 | $-COCH_3$ | $-COCH_3$ | $-CH=$ | 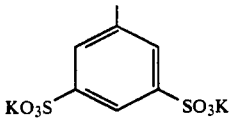 | 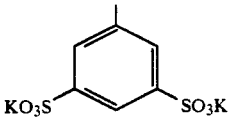 |
| 46 | 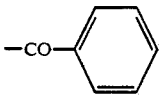 | 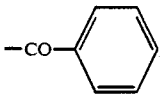 | $-CH=$ | 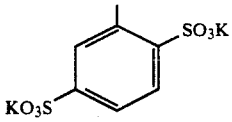 | 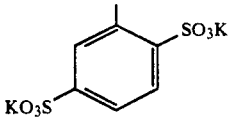 |
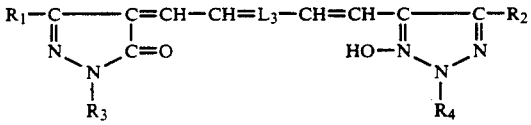
| No. | $R_1$ | $R_2$ | $L_2$ | $R_3$ | $R_4$ |
|---|---|---|---|---|---|
| 47 | $-CN$ | $-CN$ | $-CH=$ | 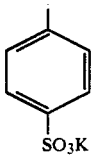 | 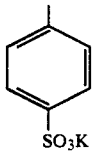 |
| 48 | $-CN$ | $-CN$ | $-CH=$ | 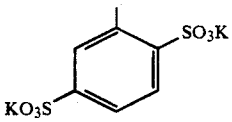 | 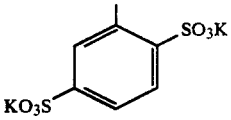 |
| 49 | $-CN$ | $-CN$ | $-CH=$ | 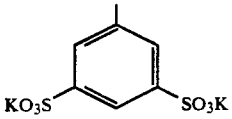 | 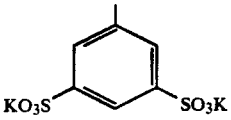 |
| 76' | $-CN$ | $-COCH_3$ | $-CH=$ | 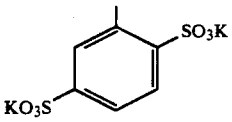 | 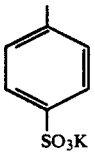 |
| 50 | $-CN$ | $-CN$ | $-CH=$ | 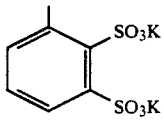 | 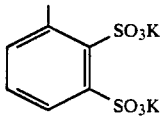 |

-continued
| | | | | | |
|---|---|---|---|---|---|
| 51 | $-CN$ | $-CN$ | $-\overset{C_2H_5}{\overset{\vert}{C}}=$ | 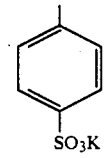 | 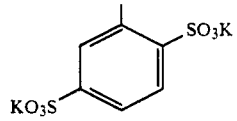 |
| 52 | $-CN$ | $-CN$ | $-CH=$ | 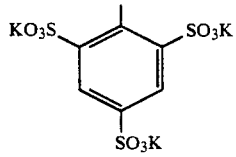 | 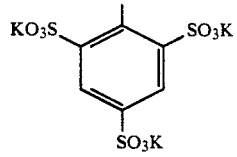 |
| 53 | $-CN$ | $-CN$ | $-CH=$ | 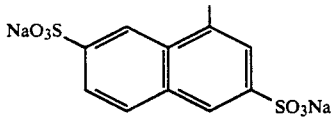 | 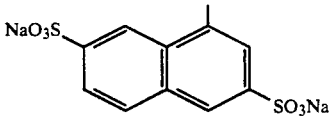 |
| 54 | $-CN$ | $-CN$ | 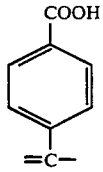 | 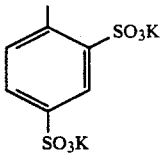 | 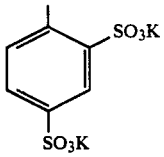 |
| 55 | $-CN$ | $-CN$ | $=CH-$ | 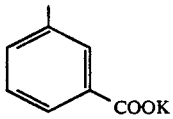 | 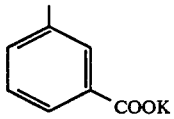 |
| 56 | $-CN$ | $-CN$ | $=CH-$ | 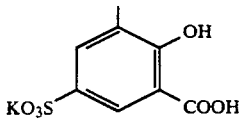 | 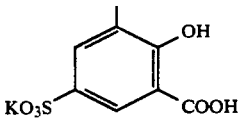 |
| 57 | $-CF_3$ | $-CF_3$ | $=CH-$ | 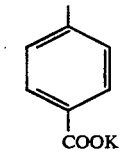 | 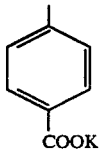 |
| 76''' | $-COCH_3$ | $-CONH_2$ | $=CH-$ | 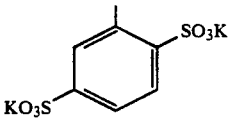 | 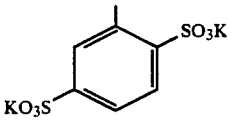 |
| 62 | $-CF_3$ | $-CF_3$ | $=CH-$ | 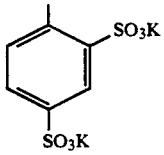 | 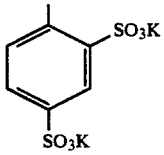 |
| 63 | $-(CF_2)_2F$ | $-(CF_2)_2F$ | $=CH-$ | 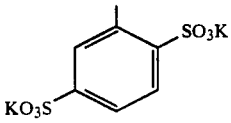 | 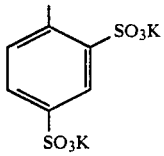 |

-continued
| | | | | | |
|---|---|---|---|---|---|
| 76'''' | —CN | —CO— 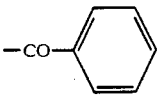 | =CH— | 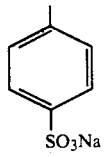 | 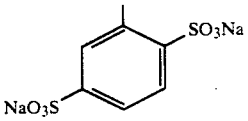 |
| 69 | —$CONH_2$ | —$CONH_2$ | =CH— | 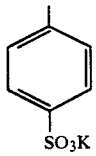 | 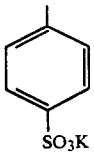 |
| 70 | —$CONH_2$ | —$CONH_2$ | =CH— | 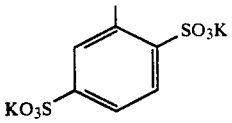 | 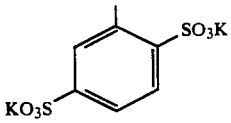 |
| 71 | —$CONH_2$ | —$CONH_2$ | =CH— | 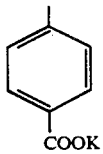 | 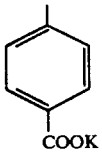 |
| 72 | —$CONHCF_2$ | —$CONHCF_2$ | =CH— | 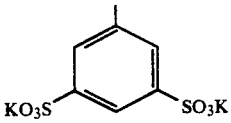 | 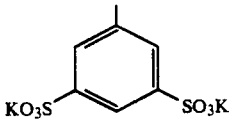 |
| 73 | —$COCH_3$ | —$COCH_3$ | =CH— | 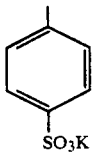 | 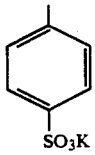 |
| 74 | —$COCH_3$ | —$COCH_3$ | =CH— | 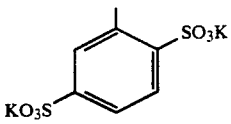 | 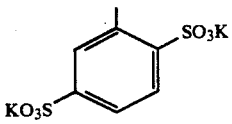 |
| 75 | —$COCH_3$ | —$COCH_3$ | =CH— | 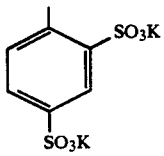 | 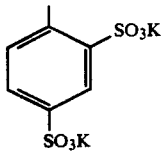 |
| 76 | —$COCH_3$ | —$COCH_3$ | =CH— | 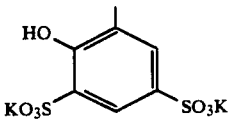 | 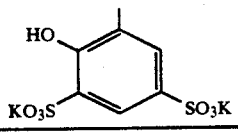 |
| No. | $R_1$ | $R_2$ | $L_3$ | $R_3$ | $R_4$ |
|---|---|---|---|---|---|
| 77 | —$COCH_3$ | —$COCH_3$ | =CH— | 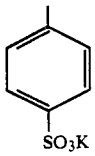 | 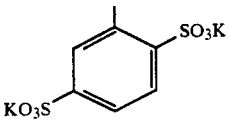 |

-continued

| | | | | | |
|---|---|---|---|---|---|
| 78 | $-COCH_3$ | $-COCH_3$ | $=CH-$ | 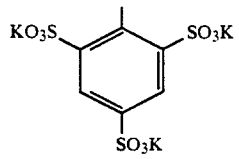 | 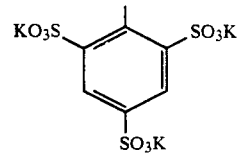 |
| 76'' | $-CN$ | $-COCH_3$ | $=CH-$ | 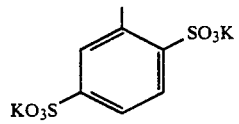 | 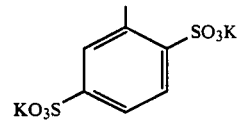 |
| 81 | $-COCH_3$ | $-COCH_3$ | $=CH-$ | 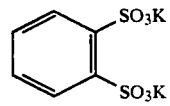 | 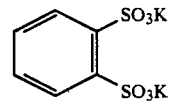 |
| 82 | $-COCH_3$ | $-COCH_3$ | $-CH=$ | 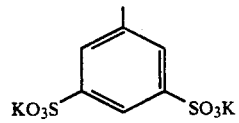 | 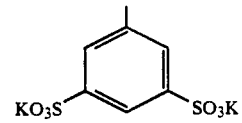 |
| 83 | 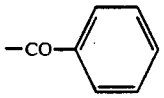 | 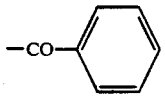 | $=CH-$ | 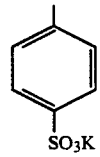 | 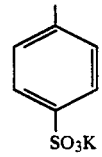 |
| 84 | 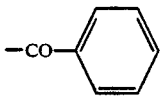 | 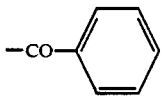 | $=CH-$ | 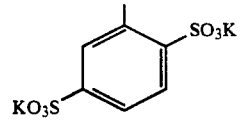 | 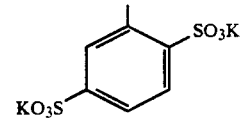 |
| 85 | $-COCH_3$ | $-COCH_3$ | $C_3H_7(i)$ \| $=C-$ | 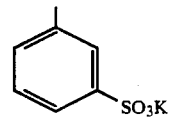 | 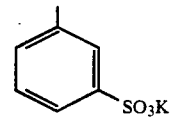 |

In addition to the dyes exemplified above, the compounds which are exemplified by Nos. (2), (3), (7), (9), (15), (16), (18), (19), (21), (22), (24), (25), (27), (33), (34), and (35) described in the specification of Japanese Patent Laid Open Publication No. 62-165656 of pages 179 to 199 can be preferably used for the present invention.

The dyes of the invention can be synthesized according to the method described in the specification of said Japanese Patent Laid Open Publication No. 62-165656.

In the photosensitive silver halide photographic material of the invention, Compound [I] of the invention may be incorporated into the silver halide emulsion layer of the invention or the other silver halide emulsion layers as an anti-irradiation dye, or may be incorporated into a non-photosensitive hydrophilic colloidal layer as a filter dye or anti-halation dye. In the silver halide emulsion layers containing the dyes of the invention, it is preferable to incorporate the compounds with $m=0$ and $n=0$ in Formula [I] into a blue-sensitive silver halide emulsion layer, those with $m=1$ and $n=0$ into a green-sensitive emulsion layer and those with $m=1$ and $n=1$ into a red-sensitive emulsion layer.

In the present invention, the compounds with $m=1$ and $n=0$ and with $m=1$ and $n=1$ are preferred, and those with $m=1$ and $n=1$ are especially preferred, wherein they are contained preferably at least in the red sensitive silver halide emulsion layer.

The dyes of the invention may be used in combination of two or more, or with the other dyes by application. Usually, they can be incorporated into a silver halide emulsion layer or the other hydrophilic colloidal layers by adding them or the organic and inorganic alkalline salts thereof dissolved or emulsified in water or an organic solvent (such as alcohols, glycols, cellosoves, dimethylformaldehyde, dibutylphthalate, and tricresyl phosphate) to a coating solution, and then by coating it on a photographic material.

The photographic material of the invention preferably contains a brightening agent scavenger for controlling a maximum absorption wave length and sharpening an absorption waveform of a highly decolorant dye contained in the photographic component layers.

The brightening agent scavenger is preferably present in the same layer as the dye of the invention, and in case of a diffusible dye, the scavenger may be contained in the other layers than that containing the dye since it can diffuse to that containing the scavenger before coated layers dry up.

An addition rate of Compound [I] of the invention may vary by application and is not particularly limited; generally, it is at the range of 0.01 to 1.0 mg/dm$^2$, preferably 0.03 to 0.4 mg/dm$^2$.

The brightening agent scavenger will be explained below.

The scavenger may be any compound as far as it is capable of scavenging a brightening agent, but particularly useful are hydrophilic polymers. Examples of such polymers are polyvinyl pyrrolidone, copolymers containing vinyl pyrrolidone as a repeating unit, poly-N-vinyl-5-methyl-2-oxazolidinone described in Japanese Patent Publication No. 48-31842, polymers of N-vinylamide compounds represented by the general formula $CH_2$—$CHNR_1COR_2$, hydrophilic polymers containing a cationic nitrogen-containing active group disclosed in Japanese Patent Laid Open Publication No. 48-42732, polymers of N-morpholinoalkyl alkenoylamide disclosed in Japanese Patent Publication No. 44-2522, and copolymers of vinyl alcohol and vinyl pyrrolydone disclosed in Japanese Patent Publication No. 47-20738.

Of these, polyvinyl pyrrolydone or copolymers thereof are preferable as a scavenger in the present invention.

The molecular weight of said hydrophilic polymers used in the invention is more than 1,000, preferably more than 10,000, more preferably 50,000 to 1,000,000 in terms of weight-average molecular weight.

In the invention, a scavenger may be contained in any of the photosensitive layers including a silver halide emulsion layer of the invention and the non-photosensitive layers. Preferably, it is contained in a non-photosensitive layer.

The scavenger in the invention is normally used in a coating amount of 0.05 to 3.0 mg/dm$^2$, preferably 0.1 to 2.0 mg/dm$^2$.

An addition rate of the scavenger is preferably 0.1 to 50 wt %, more preferably 1 to 30 wt % of gelatin in a photographic layer containing the scavenger.

Next, the mercapto compound represented by Formula [II] (hereinafter referred to as Compound [II] of the invention) will be explained.

In Formula [II], Q represents a group of atoms necessary for forming a 5- or 6-membered heterocyclic ring including one condensed with a benzene ring. The examples of a heterocyclic ring formed by Q are an imidazole ring, a tetrazole ring, a thiazole ring, an oxazole ring, a selenazole ring, a benzoimidazole ring, a naphthoimidazole ring, a benzothiazole ring, a naphthothiazole ring, a benzoselenazole ring, a naphthoselenazole ring, and a benzoxazole ring.

The examples of a cation represented by M are an alkali metal such as sodium and potassium, and an ammonium group.

Compounds [II] of the invention are preferably represented by the following Formulas [SA], [SB], [SC] and [SD].

Formula [SA]

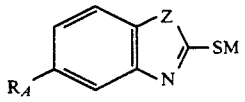

wherein $R_A$ represents a hydrogen atom, an alkyl group, an alkoxy group, an aryl group, a halogen atom, a carboxyl group or salt thereof, a sulfo group or salt thereof, or an amino group; Z represents —NH—, —O—, or —S—; and M represents a hydrogen atom, an alkali metal atom, or an ammonium group.

Formula [SB]

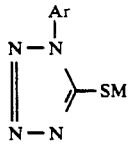

wherein Ar represents

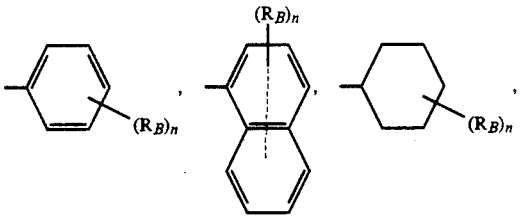

$R_B$ represents an alkyl group, an alkoxy group, a carboxyl group or salt thereof, a sulfo group or salt thereof, a hydroxyl group, an amino group, an acylamino group, a carbamoyl group, or a sulfonamide group; n represents an integer of 0 to 2, preferably 1 or 2; and M represents a hydrogen atom, an alkali metal atom, or an ammonium group.

In Formulas [SA] and [SB], the alkyl group represented by $R_A$ and $R_B$ is exemplified by methyl, ethyl, and butyl groups, the alkoxy group by methoxy and ethoxy groups, and the salts of the sulfo and carboxyl groups by sodium salt and ammonium salt.

In Formula [SA], the aryl group represented by $R_A$ is exemplified by phenyl and naphtyl groups, and the halogen atom by chlorine and bromine atoms.

In Formula [SB], the acylamino group represented by $R_B$ is exemplified by methyl carbonylamino and benzoylamino groups, the carbamoyl group by ethyl carbamoyl and phenyl carbamoyl groups, the sulfonamide group by methyl sulfonamide and phenyl sulfonamide groups.

The preceding alkyl, alkoxy, aryl, amino, acylamino, carbamoyl, and sulfonamide groups include the substituted groups.

Formula [SC]

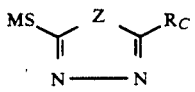

wherein Z represents

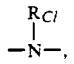

an oxygen atom, or a sulfur atom; $R_C$ represents a hydrogen atom, an alkyl group, an aryl group, an alkenyl group, a cycloalkyl group, $—SR_{C4}—$,

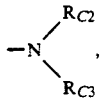

$—NHCOR_{C4}$, $—HNSO_2R_{C4}$, or a heterocyclic group; $R_{C2}$ represents a hydrogen atom, an alkyl group, an alkenyl group, a cycloalkyl group, an aryl group, $—COR_{C4}—$, or $—SO_2R_{C6}—$; $R_{C3}$ and $R_{C4}$ represent a hydrogen atom, an alkyl group, or an aryl group; $R_{C5}$, and $R_{C6}$ represent alkyl or aryl groups; and M represents the same atoms and group as M in Formula [SA].

The examples of the alkyl groups represented by $R_{C2}$ to $R_{C6}$ are a methyl group, a benzyl group, an ethyl group and a propyl group, and those of the aryl groups represented by them are phenyl and naphthyl groups.

The example of the alkenyl group represented by $R_C$ and $R_{C2}$ is a propenyl group, and that of the cycloalkyl group is a cyclohexyl group.

The examples of the heterocyclic group represented by $R_C$ are furyl and pyridinyl groups.

The alkyl and aryl groups represented by $R_C$ and $R_{C2}$ to $R_{C4}$, the alkenyl and cycloalkyl groups represented by $R_C$ and $R_{C2}$, and the heterocyclic group represented by $R_C$ include the substituted groups.

Formula [SD]

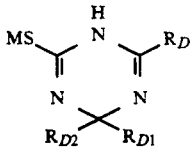

wherein $R_D$ and M represent the same groups as $R_C$ and M in Formula [SC], respectively.

$R_{D1}$ and $R_{D2}$ represent the same groups as $R_{C2}$ and $R_{C3}$ in Formula [SC], respectively.

In the present invention, it is preferable to use the compound represented by Formula [SB] and to designate a substituted phenyl group as $A_r$.

Compounds [II] of the present invention are added to a silver halide emulsion to improve aging stability of the emulsion at regular temperature as well as fogging.

The examples of Compounds [II] are given below, but it is to be understood that the invention is not limited to the exemplified compounds.

SA-1

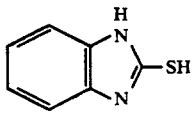

SA-2

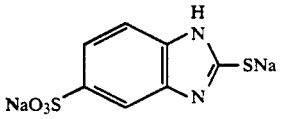

-continued

SA-3

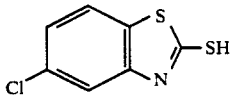

SA-4

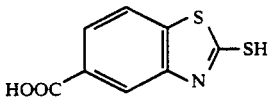

SA-5

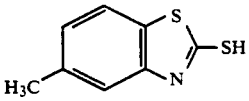

SA-6

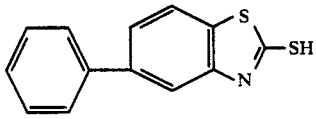

SA-7

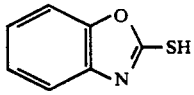

SA-8

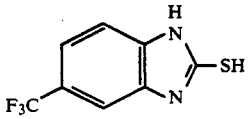

SB-1

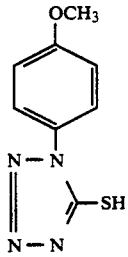

SB-2

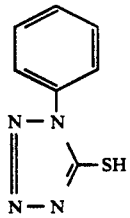

SB-3

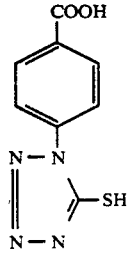

-continued
SB-4
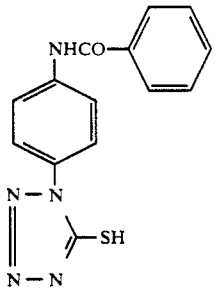
SB-5
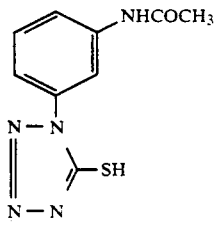
SB-6
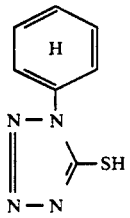
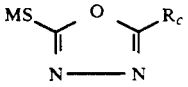
| No. | $R_c$ | M |
|---|---|---|
| SC-1 | $-C_2H_5$ | —H |
| SC-2 | $-CH_2-CH=CH_2$ | —H |
| SC-3 | $-CH=CH-CH_2-CH_3$ | —H |
| SC-4 | $-C_7H_{15}$ | —H |
| SC-5 | $-C_9H_{19}$ | —Na |
| SC-6 | 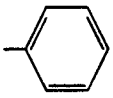 | —H |
| SC-7 | $-C_4H_9(t)$ | —H |
| SC-8 | 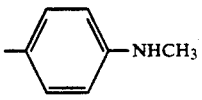 | —H |
| SC-9 | 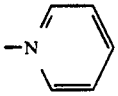 | —H |
| SC-10 | 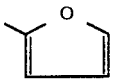 | —H |
| SC-11 | 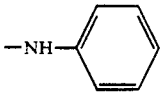 | —H |
| SC-12 | 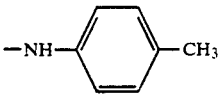 | $-NH_4$ |
| SC-13 | $-NHCOCH_3$ | —H |
| SC-14 | 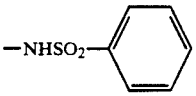 | —H |
| SC-15 | $-N(CH_3)_2$ | —H |
| SC-16 | 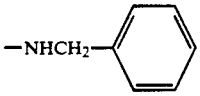 | —H |
| SC-17 | 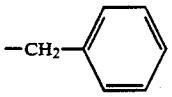 | —H |
| SC-18 | $-S-CH_3$ | —H |
| SC-19 | 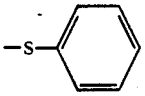 | —H |
| SC-20 | —SH | —H |
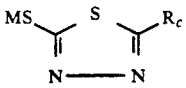
| No. | $R_c$ | M |
|---|---|---|
| SC-21 | —H | —H |
| SC-22 | $-C_2H_5$ | —H |
| SC-23 | $-C_4H_9(t)$ | —H |
| SC-24 | $-C_6H_{13}$ | —H |
| SC-25 | 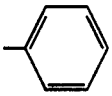 | —H |
| SC-26 | 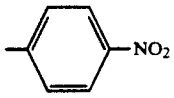 | —H |
| SC-27 | 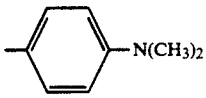 | —H |
| SC-28 | 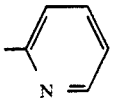 | —H |

-continued

| | | |
|---|---|---|
| SC-29 | 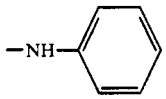 | —H |
| SC-30 | $-NH_2$ | —H |
| SC-31 | $-CH_2CH{=}CH_2$ | —H |
| SC-32 | —SH | —H |
| SC-33 | $-NHCOC_2H_5$ | —H |

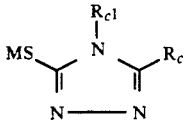

| No. | $R_c$ | $R_{c1}$ | M |
|---|---|---|---|
| SC-34 | $-C_2H_5$ | —H | —H |
| SC-35 | $-CH_3$ | $-CH_3$ | —H |
| SC-36 | $-CH_3$ | 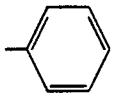 | —H |
| SC-37 | $-NHCOCH_3$ | $-CH_3$ | —H |
| SC-38 | 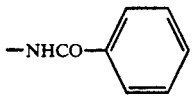 | 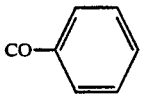 | —H |
| SC-39 | $-NHCOCH_3$ | $-COCH_3$ | —H |
| SC-40 | $-NHCOCH_3$ | 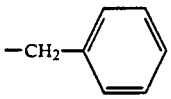 | —H |

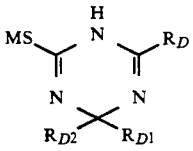

| No. | $R_D$ | $R_{D1}$ | $R_{D2}$ | M |
|---|---|---|---|---|
| SD-1 | $-C_2H_5$ | $-CH_3$ | $-CH_3$ | —H |
| SD-2 | 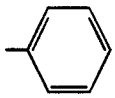 | $-CH_3$ | $-CH_3$ | —H |
| SD-3 | $-NH_2$ | —H | 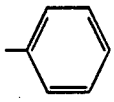 | —H |
| SD-4 | 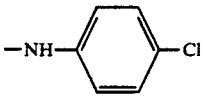 | —H | $-C_4H_9$ | —H |
| SD-5 | $-NHCOCH_3$ | $-CH_3$ | $-CH_3$ | —H |
| SD-6 | 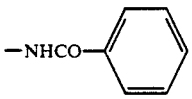 | $-CH_3$ | $-CH_3$ | —H |

-continued

| | | | |
|---|---|---|---|
| SD-7 | 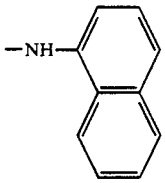 | $-CH_3$ | $-C_3H_7(i)$ | —H |
| SD-8 | 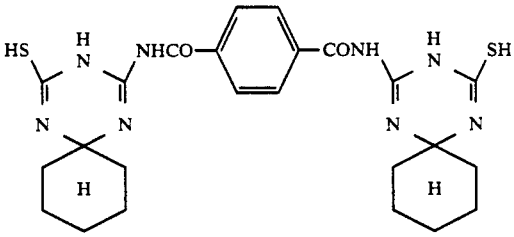 | | | |

Compounds [II] include the compounds disclosed in, for example, Japanese Patent Publication No. 40-28496, Japanese Patent Laid Open Publication No. 50-89034, Journal of Chemical Society, 49, 1748 (1927), 1723 (1951) and 4237 (1952), Journal of Organic Chemistry 39, 2469 (1965), U.S. Pat. No. 2,824,001, Japanese Patent Laid Open Publication No. 56-111846, British Patent No. 1,275,701, and U.S. Pat. Nos. 3,266,897 and 2,403,927. The compounds can be synthesized according to the methods described in these publications.

In order to incorporate Compound [II] into a silver halide emulsion containing silver halide grains of the invention, it is dissolved in water or in an organic solvent readily miscible with water (such as methanol or ethanol), and the resulting solution is added to the emulsion.

Compound [II] may be used either alone or in combination of two or more, or in combination with a stabilizer or antifoggant other than Compound [II].

Compound [II] may be added at any of the following stages; in forming silver halide grains, after grain formation and before chemical sensitization, in initiating chemical sensitization, during chemical sensitization, and after finishing chemical sensitization through coating solution preparation.

An addition amount of Compound [II] is not particularly limited, but generally, it is at the range of $1\times10^{-6}$ mol to $1\times10^{-1}$ mol, preferably $1\times10^{-5}$ to $1\times10^{-2}$ mol per mol of silver halide.

The compounds represented by Formulas [III] and [IV](hereinafter referred to as Hardeners [III] and [IV] of the invention) will now be explained.

The arkyl groups represented by $R_9$ and $R_{10}$ in the Formula [III] are, for example, methyl, ethyl and buthyl groups, and alkoxy groups represented by them are methoxy, ethoxy and butoxy groups. M' in —OM' group represented by $R_9$ and $R_{10}$ represents a sodium atom or a potassium atom, for example.

Cyanuric chloride type Hardener [III] is described in U.S. Pat. No. 3,645,743, Japanese Patent Publication Nos.47-6151, 47-33380, 51-9607, and Japanese Patent Laid Open Publication Nos. 48-19220, 51-78788, 52-60612, 52-128130, 52-130326, and 56-1043. Suitable one selected from those shown in said publications may be used in accordance with the foregoing standards.

The alkyl groups represented by $R_{14}$ and $R_{15}$ in Formula [IV] are, for example, methyl, ethyl and butyl groups; the alkoxy groups represented by them are, for example, methoxy, ethoxy and butoxy groups; and M' in —OM' is, for example, a sodium atom or a potassium atom.

The alkylene group represented by L is, for example, $—CH_2—$, $—(CH_2)_2—$, or $—(CH_2)_3—$, and the arylene group is, for example, p-, o-, or m- phenylene group.

Cyanuric chloride type Hardener [IV] is described in Canada Patent No. 895,808, Japanese Patent Publication No. 58-33542, and Japanese Patent Laid Open publication No. 57-40244. Any one suitably selected from those described in the publications may be used in accordance with the preceding standards.

Hardeners [III] and [IV] are used for improving film strength of the photographic emulsion layers and the other hydrophilic colloidal layers in the photosensitive silver halide photographic material of the invention, and they may be added to one or more layers selected from the photographic layers or the supplementary layers since they can diffuse to all layers. The compounds are dissolved in water or alcohol (e.g., methyl alcohol or ethyl alcohol), and then added in an amount of 1 to 100 mg, preferably 5 to 50 mg per gram of gelatin.

The compounds may be added by a batch method or an in-line method.

The examples of Hardeners [III] and [IV] are shown below. It is to be understood, however, that the invention is not limited to those examples.

Compounds represented by Formula [III]

III-1

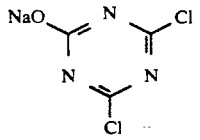

III-2

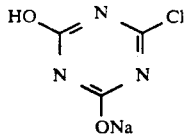

III-3

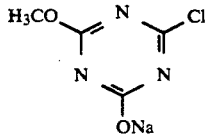

III-4

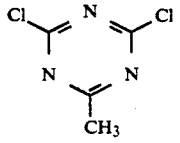

III-5

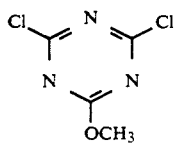

-continued

III-6

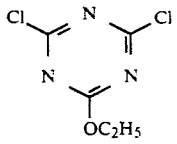

III-7

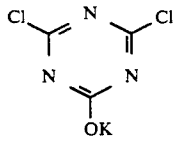

III-8

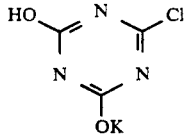

IV-2

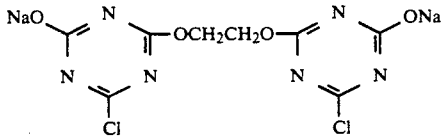

IV-3

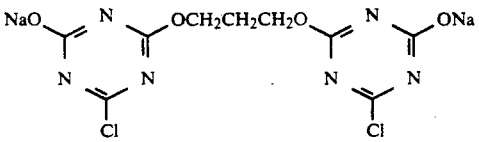

IV-4

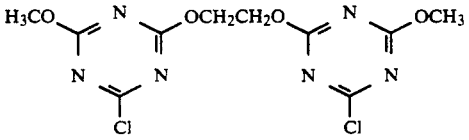

IV-5

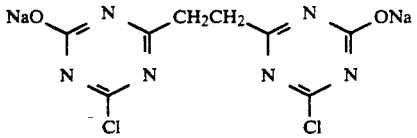

III-9

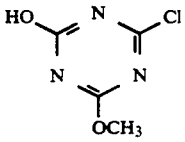

III-10

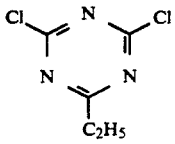

III-11

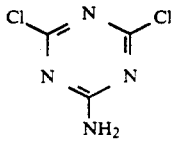

-continued

III-12

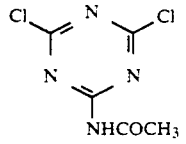

III-13

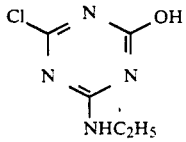

Compounds represented by Formula [IV]

IV-1

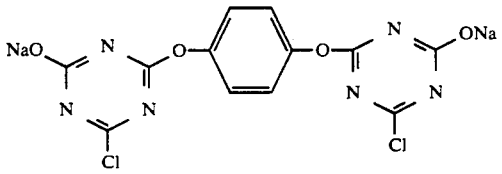

IV-6

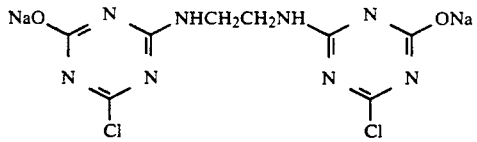

IV-7

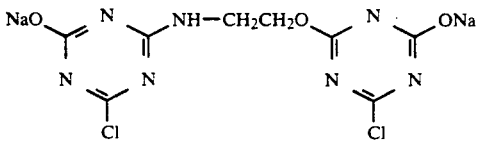

IV-8

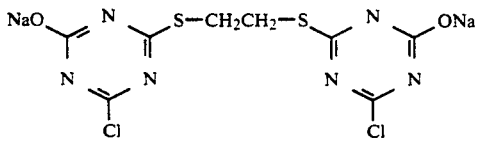

IV-9

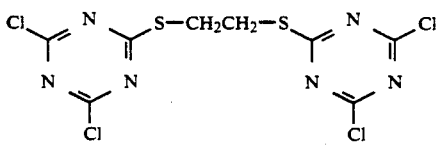

IV-10

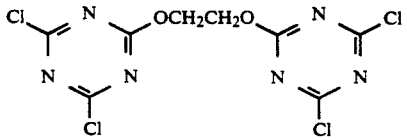

In the present invention, the sensitizing dye used for a green sensitive silver halide emulsion layer is represented preferably by the following Formula [B];

Formula [B]

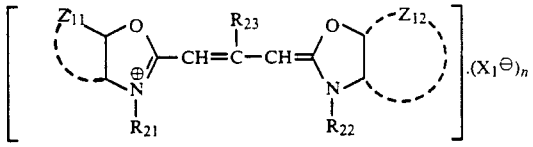

wherein $Z_{11}$ and $Z_{12}$ represent a group of atoms necessary to form a benzene ring or a naphthalene ring condensed with oxazoles. The ring includes a substituted one. Preferred substituents are a halogen atom, an aryl group, an alkyl group and an alkoxy group. More preferred substituents are a halogen atom, a phenyl group and a methoxy group, and the most preferred is a phenyl group.

In the invention, it is preferable that $Z_{11}$ and $Z_{12}$ represent the benzene rings condensed with the oxazole rings and that 5-position of at least one of the benzene rings is replaced by a phenyl group or that 5-position of one of the benzene rings is replaced by a phenyl group and 5-position of the other benzene ring is replaced by a halogen atom.

$R_{21}$ and $R_{22}$ represent independently an alkyl group, an alkenyl group and an aryl group, preferably an alkyl group. More preferably, $R_{21}$ and $R_{22}$ are the alkyl groups substituted by a carboxyl group or a sulfo group. Especially preferably, they are the sulfoalkyl groups having 1–4 carbon atoms. Most preferably, they are the sulfoethyl groups.

$R_{23}$ represents a hydrogen atom or an alkyl group having 1 to 3 carbon atoms, preferably a hydrogen atom or an ethyl group.

$X_1^{\ominus}$ represents an anionic ion, for example, a halogen ion of chlorine, bromine and iodine, $CH_3SO_4$, $C_2H_5SO_4$ and

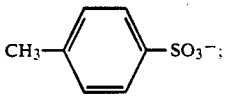

n denotes 0 to 1; provided that said dye form an intramoleular salt, n is 0.

The examples of the sensitizing dyes represented by Formula [B] that are preferably used in the invention are shown below.

B-1

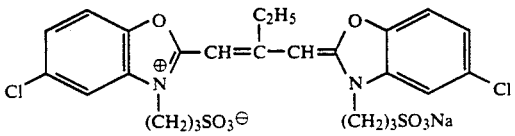

-continued
B-2
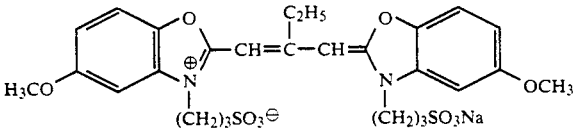
B-3
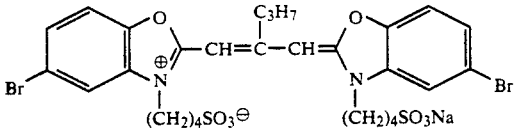
B-4
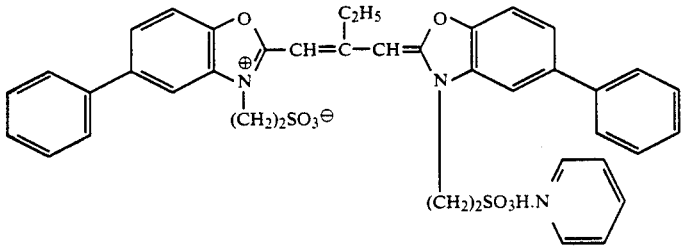
B-5
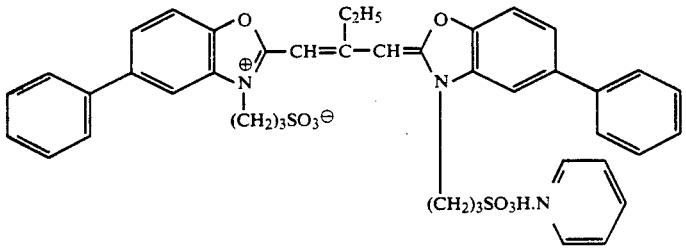
B-6
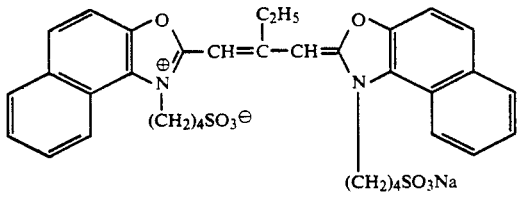
B-7
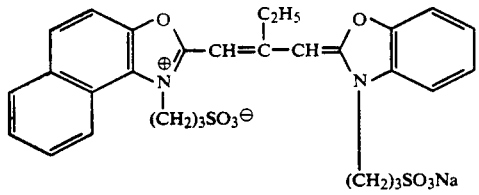
B-8
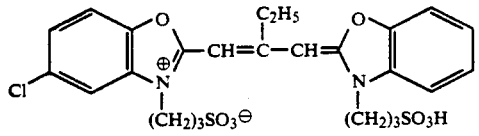
B-9
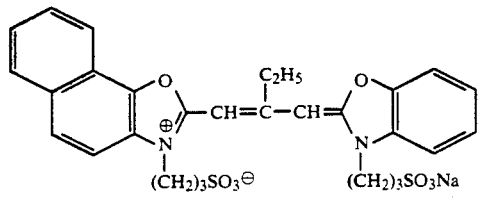

-continued

B-10

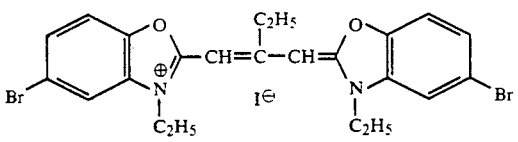

B-11

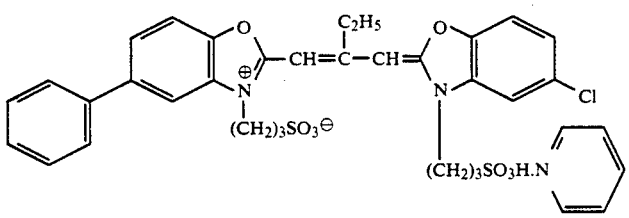

In the invention, the sensitizing dyes to be used for a red sensitive silver halide layer are represented preferably by the following Formulas [C] and [D].

Formula [C]

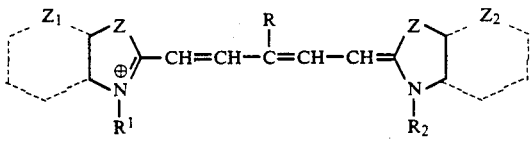

$(X^{\ominus})l-1$

Formula [D]

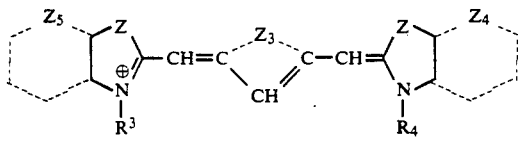

$(X^{\ominus})l-1$ wherein R represents a hydrogen atom or an alkyl group $R_1$ to $R_4$ represent independently an alkyl group and an aryl group $Z_1$, $Z_2$, $Z_4$ and $Z_5$ represent independently the groups of atoms necessary for forming a benzene ring or a naphthalene ring condensed with a thiazole ring or a selenazole ring; $Z_3$ represents a hydrocarbon group necessary for forming a 6-membered ring; l denotes 1 or 2; Z denotes a sulfur atom or a selenium atom; and $Z^{\ominus}$ represents an anionic ion. R is preferably a hydrogen atom, a methyl group or an ethyl group, more preferably a hydrogen atom or an ethyl group.

$R_1$ to $R_4$ represent linear or branched alkyl groups or aryl groups, including substituted groups. The rings formed by $Z_1$, $Z_2$, $Z_4$ and $Z_5$ include the substituted ones. The preferred substituents are a halogen atom, an aryl group, an arkyl group and an alkoxy group, and more preferably a halogen atom (for example, a chlorine atom), a phenyl group, and a methoxy group.

The ring formed by $Z_3$ includes one with a substituent (for example, an alkyl group).

X represents an anionic ion (for example Cl, Br, 1,

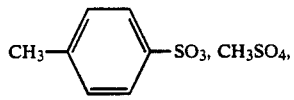

$C_2H_5SO_4$; ; denotes 1 or 2, provided that said dye forms an intramolecular salt, l denotes 1.

The examples of the sensitizing dyes represented by Formulas [C] and [D] which are preferably used in the invention are shown below.

C-1

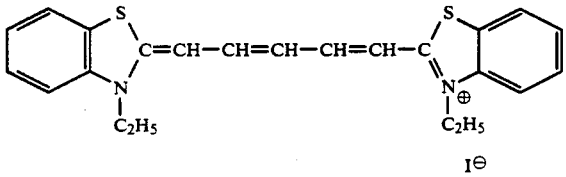

C-2

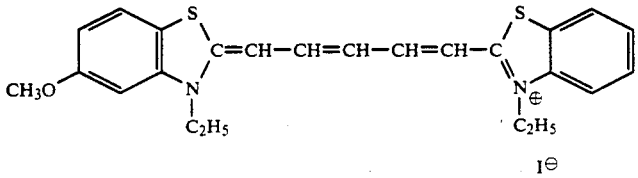

-continued
C-3
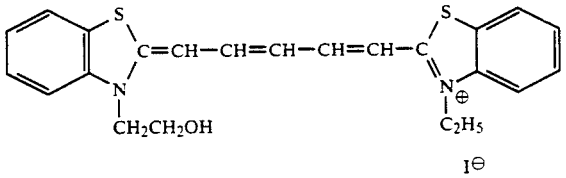
C-4
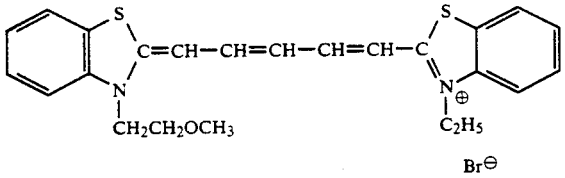
C-5
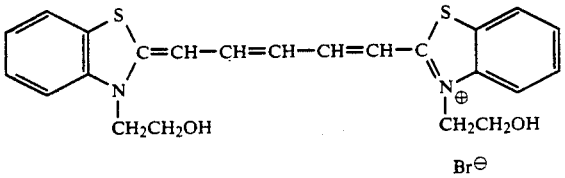
C-6
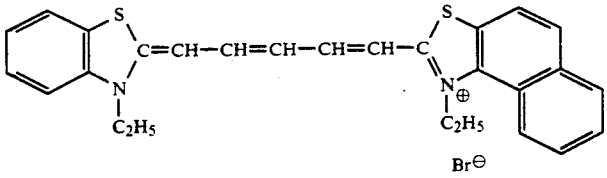
C-7
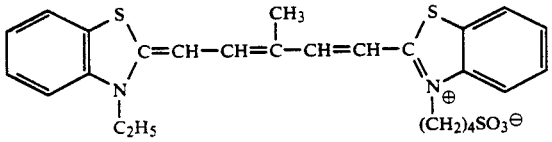
C-8
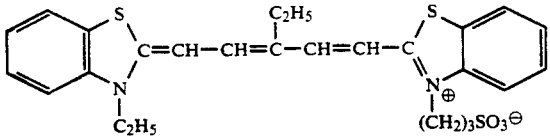
C-9
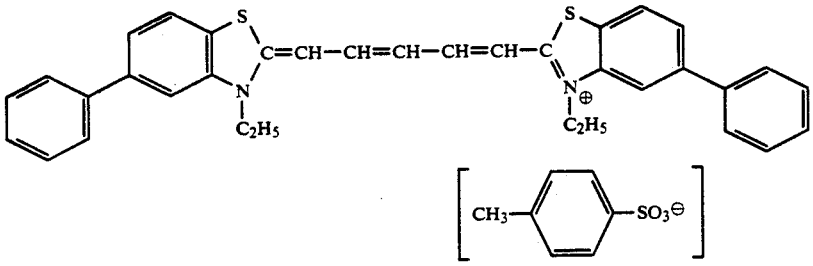
C-10
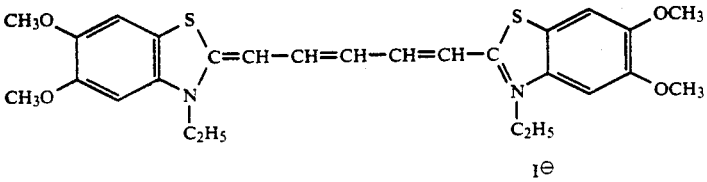

-continued
C-11
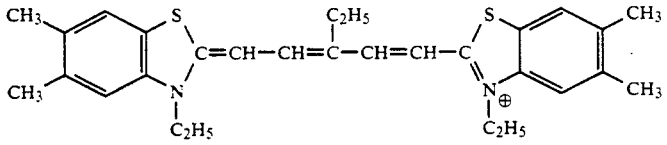
C-12
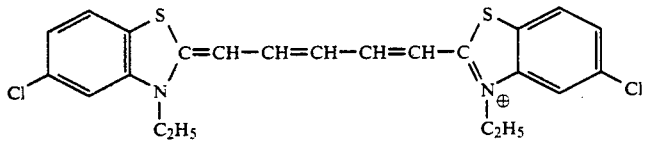
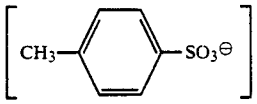
C-13
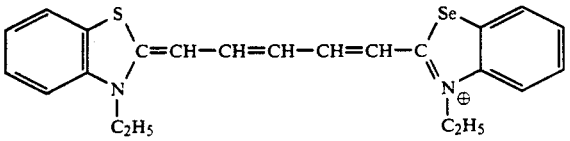
$I^{\ominus}$
C-14
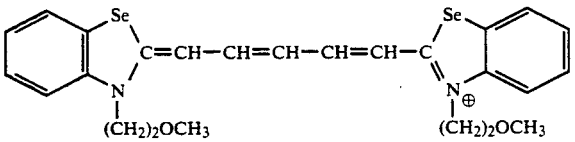
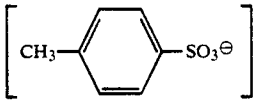
D-1
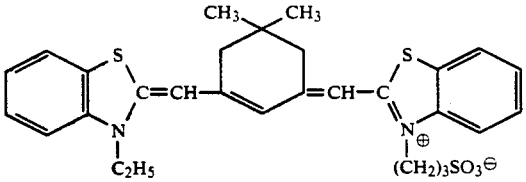
D-2
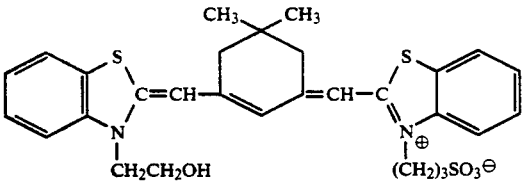
D-3
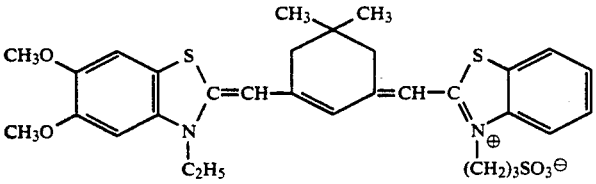
D-4
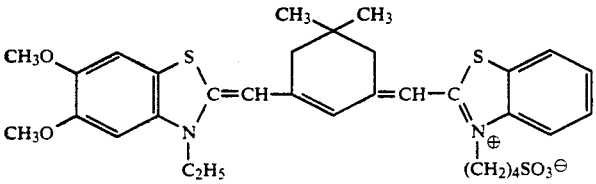

-continued
D-5
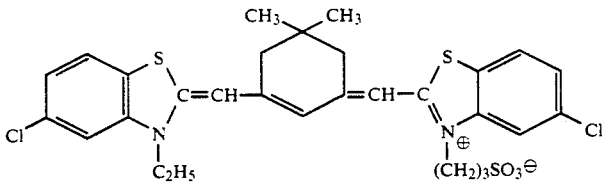
D-6
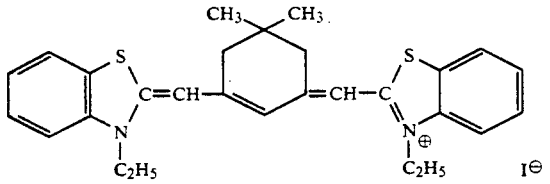
D-7
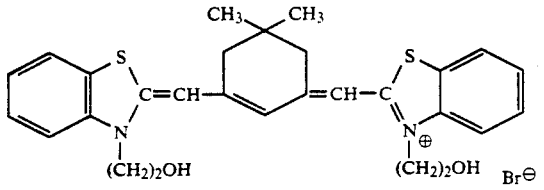
D-8
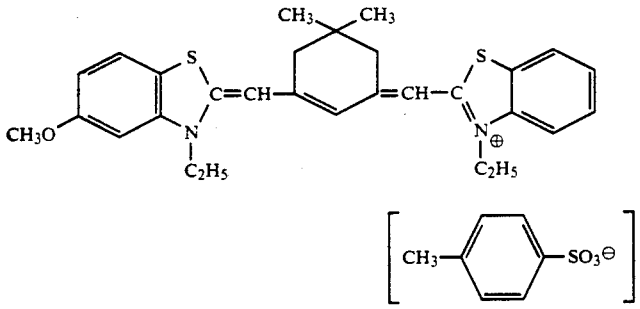
D-9
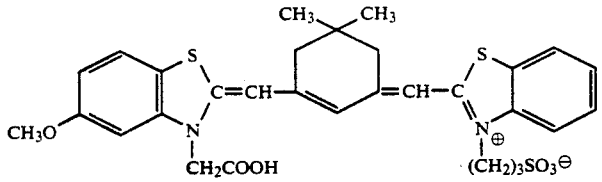
D-10
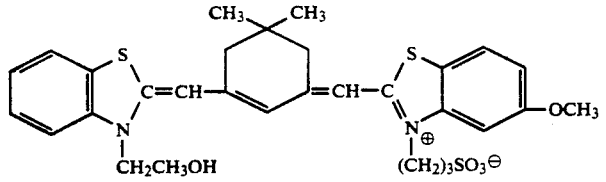
D-11
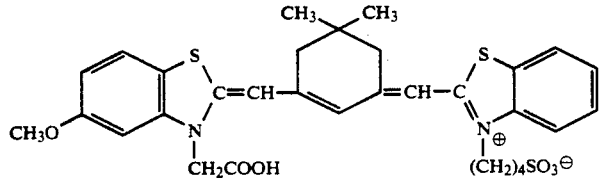
D-12
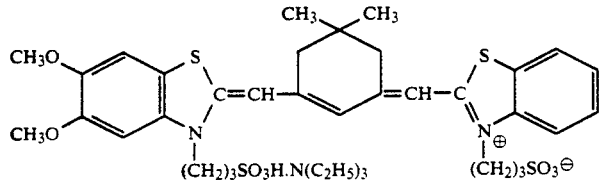

-continued

D-13

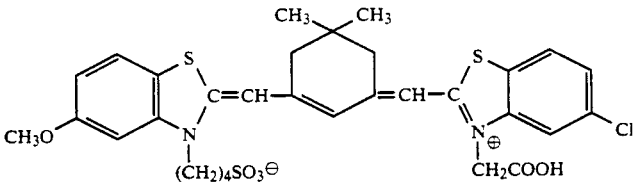

D-14

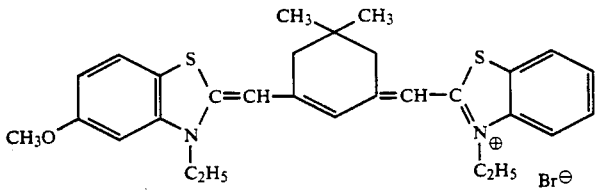

The sensitizing dyes can be incorporated by the methods well known in the art.

For example, these dyes are dissolved in water or a water-miscible solvent such as pyridine, methyl alcohol, ethyl alcohol and methyl cellosolve including mixture thereof, and they are added in a form of a solution.

An addition amount of the sensitizing dye is not particularly limited, but preferably the amount is at the range of $2\times10^{-6}$ to $1\times10^{-3}$, more preferably $5\times10^{-6}$ to $5\times10^{-4}$ per mol of silver halide.

The photosensitive silver halide photographic material of the invention can be applicable to color negative, positive films, color photographic paper and the like. Especially, it is applied to color photographic paper to atmost demonstration of the effects of the invention.

The present invention can be applied to either a single color photosensitive material or multicolor one. Usually, the multicolor photosensitive material of the invention, which is subjected to desensitization has the silver halide emulsion layers containing magenta, yellow and cyan couplers, and the non-photosensitive layers on a support with reasonable layer number and order. Said layer number and order may vary by aimed performance and application.

The photosensitive material comprises preferably a yellow dye image forming layer, an intermediate layer, a magenta dye image forming layer, an intermediate layer, a cyan dye image forming layer, an intermediate layer and a protective layer sequentially in order from a support.

The silver halide emulsion layers of the invention contain dye forming couplers.

These dye forming couplers comprise preferably the ballast groups having not less than eight carbon atoms, which make the couplers non-diffusible.

The yellow dye forming coupler is represented preferably by acylacetoanilide couplers. Of these couplers, benzoyl acetoanilide and pivaloylacetoanilide compounds can be advantageously used. They are represented preferably by the following Formula [Y];

Formula [Y]

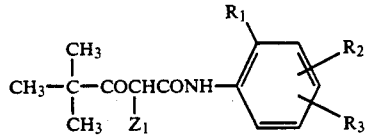

wherein $R_1$ represents a halogen atom or an alkoxy group; $R_2$ represents a hydrogen atom, a halogen atom or an alkoxy group; $R_3$ represents an acylamino group, an alkoxycarbonyl group, an alkylsulfamoyl group, an arylsulfamoyl group, an alkylsulfonamide group, an arylsulfonamide group, an alkylureid group, an arylureid group, a succineimide group, an alkoxy group, or an aryloxy group; and $Z_1$ represents a group capable of splitting off by reaction with an oxidized product of a color developing agent.

The examples of yellow couplers available are disclosed in British Patent No. 1,077,874, Japanese Patent Publication No. 45-40757, Japanese Patent Laid Open Publication No. 47-1031, 47-26133, 48-94432, 50-87650, 51-3631, 52-115219, 54-99433, 54-133329, 56-30127, U.S. Pat. Nos. 2,875,057, 3,253,924, 3,265,506, 3,408,194, 3,551,155, 3,551,156, 3,664,841, 3,725,072, 3,730,722, 3,891,445, 3,900,483, 3,929,484, 3,933,500, 3,973,968, 3,990,896, 4,012,259, 4,022,620, 4,029,508, 4,057,432, 4,106,942, 4,133,958, 4,269,936, 4,286,053, 4,304,845, 4,314,023, 4,336,327, 4,356,258, 4,386,155, and 4,401,752.

The typical examples are shown below.

Y-1

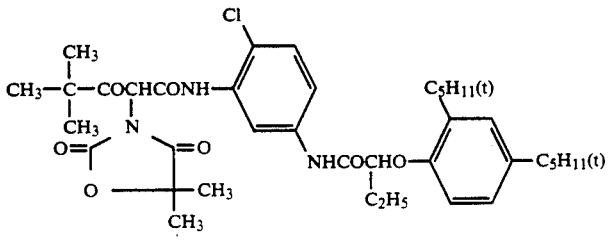

-continued
Y-2
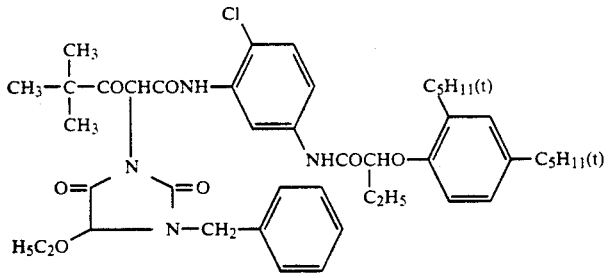
Y-3
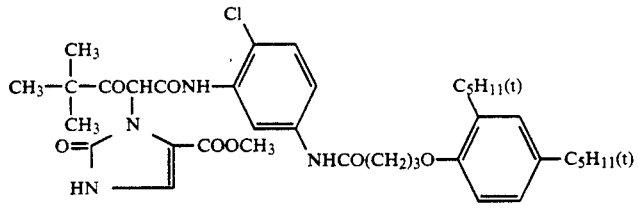
Y-4
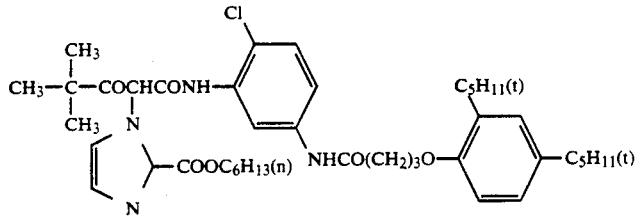
Y-5
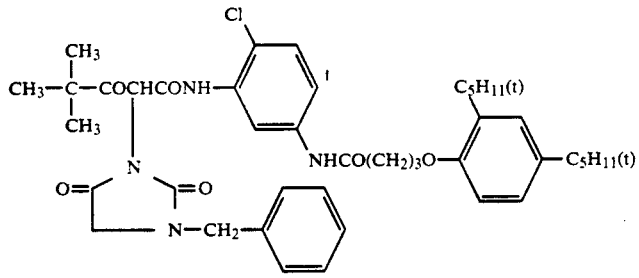
Y-6
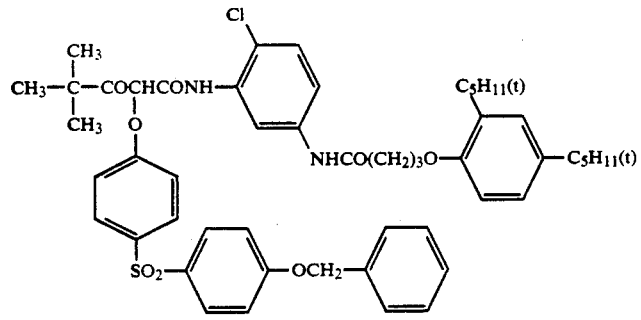
Y-7
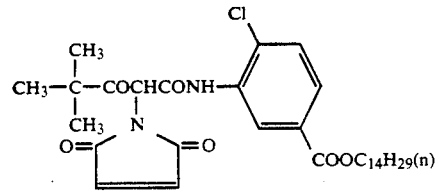

-continued

Y-8

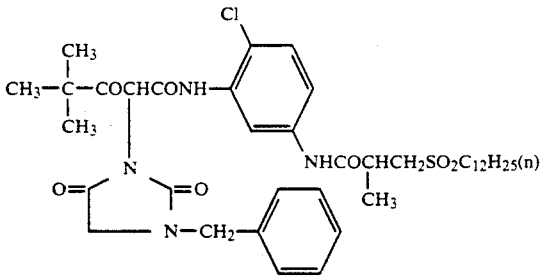

Y-9

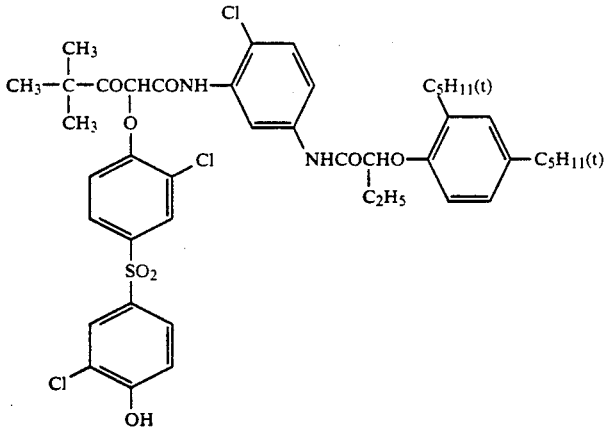

Y-10

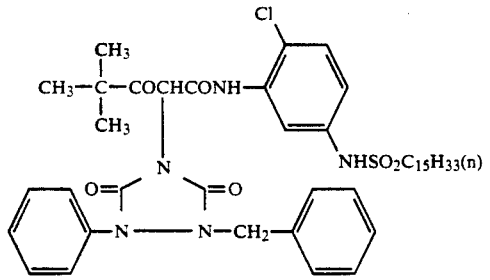

For the magenta dye forming coupler, 5-pyrazolone couplers and pyrazoloazol couplers can be preferably used. More preferably, the couplers are represented by the following Formula [P] or [a];

Formula [P]

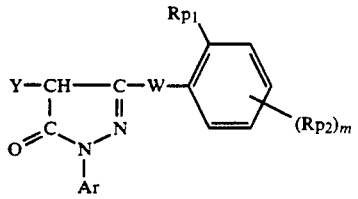

wherein Ar represents an aryl group $Rp_1$ represents a hydrogen atom or a substituent group;; $Rp_2$ represents a substituent group; Y represents a hydrogen atom or a group capable of splitting off by reaction with an oxidized product of a color developing agent; W represents —NH—, —NHCO— (a N atom is in bond with a carbon atom of a (pyrazolone nucleus) or —NHCOHN—; and m is an integer of 1 or 2.

Formula [a]

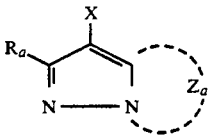

wherein $Z_a$ represents a group of non-metallic atoms necessary for forming a nitrogen containing heterocyclic ring, and the ring formed by Za has a substituent.

X represents a hydrogen atom or a group capable of splitting off by reaction with an oxidized product of a color developing agent.

Ra represents a hydrogen atom or a substituent.

The substituents represented by Ra for example, a halogen atom, an alkyl group, a cycloalkyl group, an alkenyl group, a cycloalkenyl group, an alkynil group, an aryl group, a heterocyclic group, an acyl group, a sulfonyl group, a sulfinyl group, a phosphonyl group, a carbamoyl group, a sulfamoyl group, a cyano group, a spiro compound residue, a hydrocarbon compound residue, an alkoxy group, an aryloxy group, a heterocyclic oxy group, a siloxy group, an acyloxy group, a carbamoyloxy group, an amino group, an acylamino group, a sulfonamide group, an imide group, an ureid group, a sulfamoylamino group, an alkoxy carbonylamino group, an aryloxycarbonylamino group, an alkoxycarbonyl amino group, an alkoxycarbonyl group, an aryloxycarbonyl group, an alkylthio group, an arylthio group, and a heterocyclic thio group.

These are described in, for example, U.S. Pat. Nos. 2600,788, 3,061,432, 3,062,653, 3,127,269, 3,311,476, 31,152,896, 3,419,391, 3,519,429, 3,555,318, 3,684,514, 3,888,680, 3,907,571, 3,928,044, 3,930,861, 3,930,866, 3,933,500, Japanese Patent Laid Open Publication Nos. 49-29639, 49-111631, 49-129538, 50-13041, 52-58922, 55-62454, 55-118034, 56-38043, 57-35858, 60-23855, British Patent No. 1,247,493, Belgian Patent Nos. 769,116 and 92,525, German Patent No. 2,156,111, Japanese Patent Publication No. 46-60479, Japanese Patent Laid Open Publication Nos. 59-125732, 59-228252, 59-162548, 59-171956, 60-33552, and 60-43659, German Patent No. 1,070,030, and U.S. Pat. No. 3,725,067.

The typical examples are shown below.

m-1

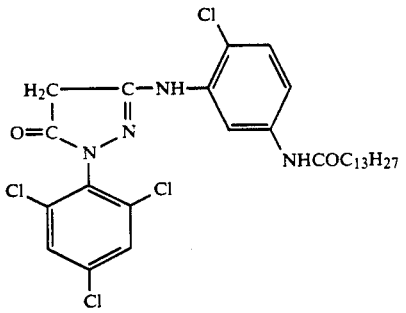

m-2

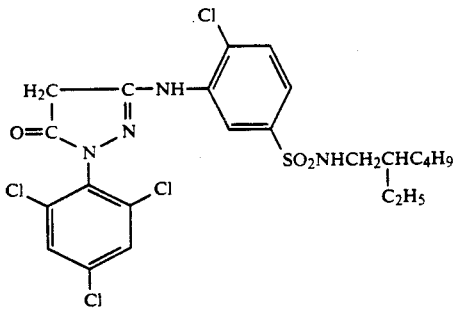

m-3

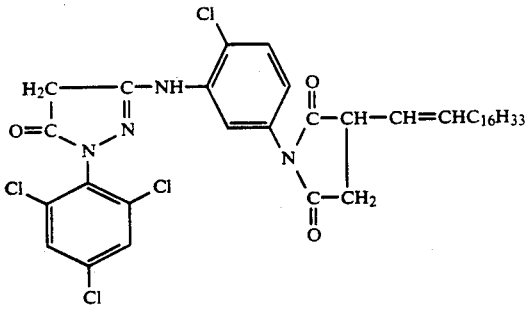

m-4

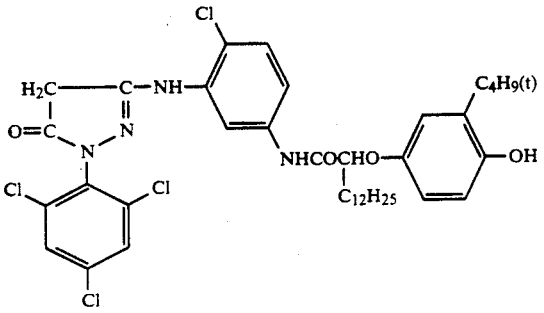

-continued
m-5
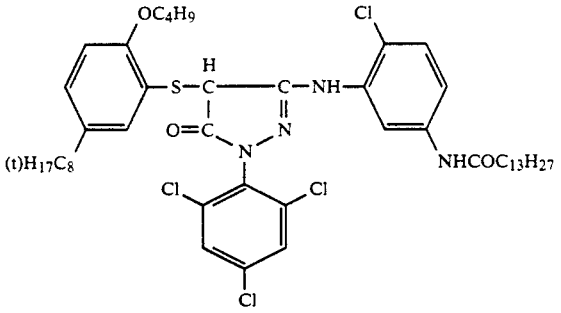
m-6
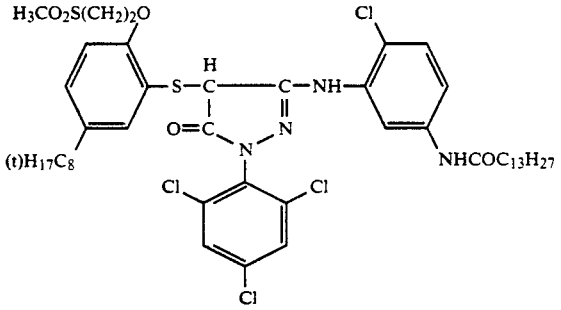
m-7
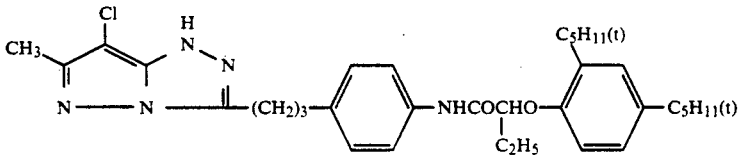
m-8
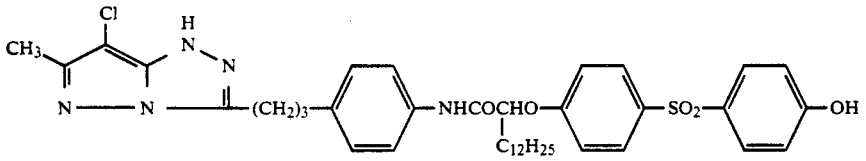
m-9
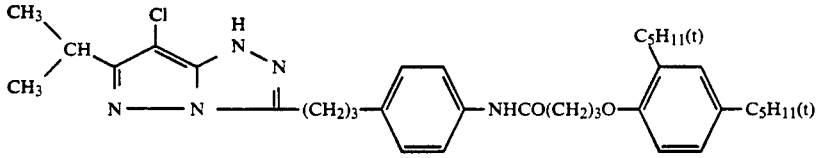
m-10
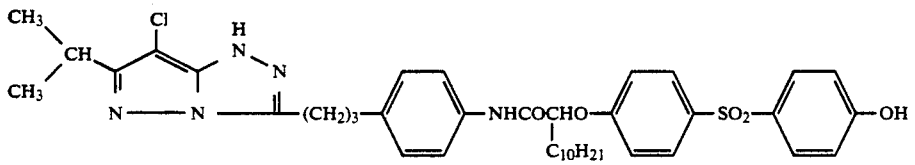
m-11
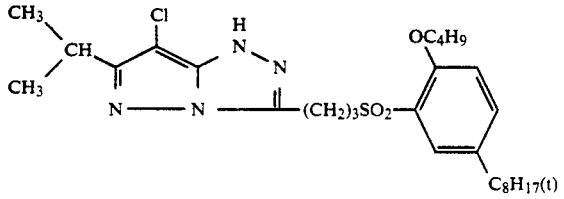

-continued
m-12
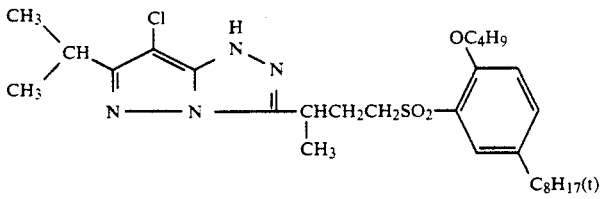
m-13
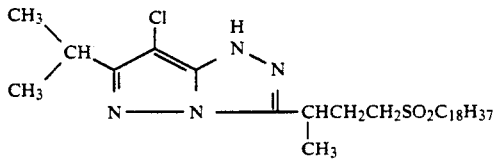
m-14
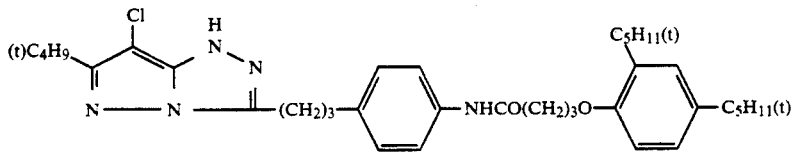
m-15
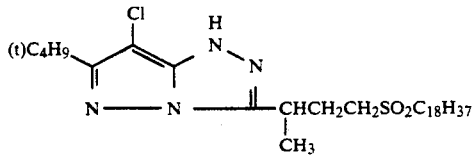
m-16
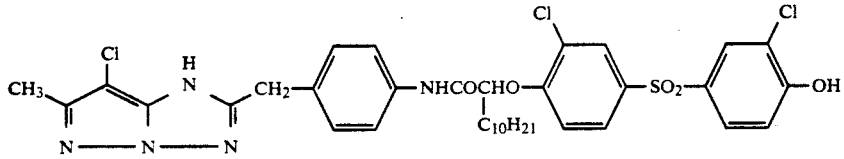
m-17
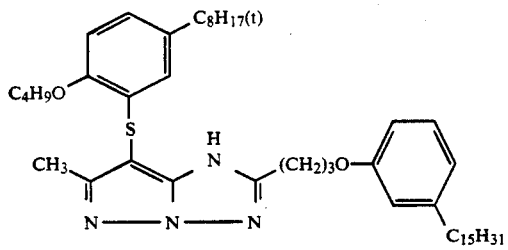
m-18
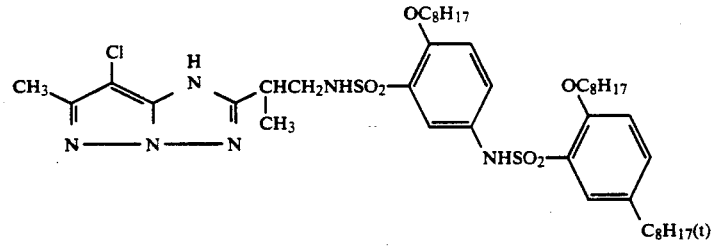
For the cyan dye forming coupler, phenolic and naphthol cyan dye forming couplers are used. The couplers are represented preferably by the following Formulas [E] and [F];
Formula [E]
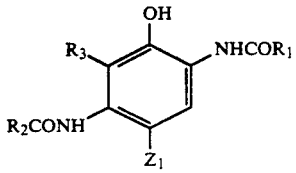
wherein $R_1$ represents an aryl group, a cycloalkyl group or a heterocyclic group; $R_2$ represents an alkyl group or a phenyl group; $R_3$ represents a hydrogen atom, a halogen atom, an alkyl group or an alkoxy group; and $Z_1$ represents a hydrogen atom or a group capable of splitting off by reaction with an oxidized product of a color developing agent.

$R_1$ to $R_3$ include substituted groups.

Formula [F]

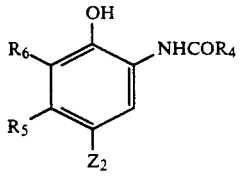

wherein $R_4$ represents an alkyl group (such as methyl, ethyl, propyl, butyl or nonyl groups); $R_5$ represents an alkyl group (such as methyl or ethyl group); $R_6$ represents a hydrogen atom, a halogen atom (such as fluorine, chlorine, or bromine), or an alkyl group (such as methyl or ethyl); and $Z_2$ represents a hydrogen atom or a group capable of splitting off by reaction with an oxidized product of a color developing agent.

$R_4$ to $R_6$ include a substituted groups.

These cyan dye image forming couplers are disclosed in U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895,826, 2,976,146, 3,002,836, 3,419,390, 3,446,622, 3,476,563, 3,737,316, 3,758,308, and U.S. Pat. No. 3,839,044, British Patent Nos. 478,991, 945,542, 1,084,480, 1,377,233, 1,388,024, and 1,543,040, and Japanese Patent Laid Open Publication Nos. 47-37425, 50-10135, 50-25228, 50-112038, 50-117422, 50-130441, 51-6551, 51-37647, 51-52828, 51-108841, 53-109630, 54-48237, 54-66129, 54-131931, 55-32071, 59-146050,59-31953, and 60-117249.

The typical examples are shown below.

CI-1

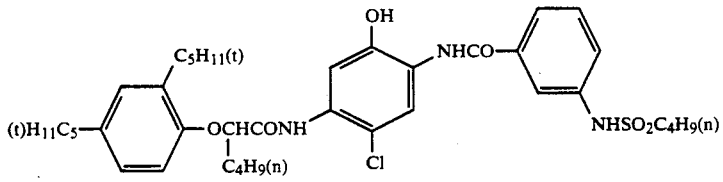

CI-2

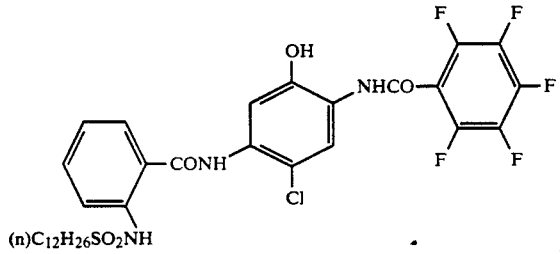

CI-3

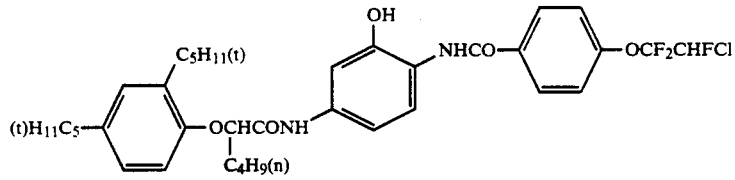

CI-4

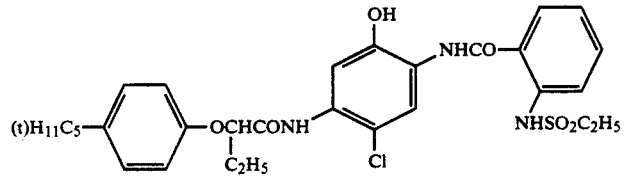

CI-5

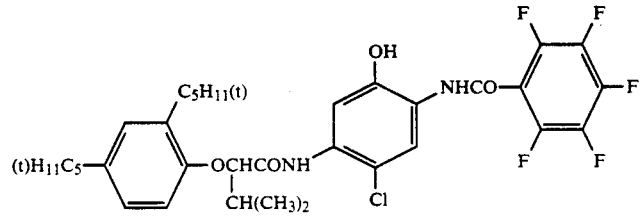

-continued
CI-6
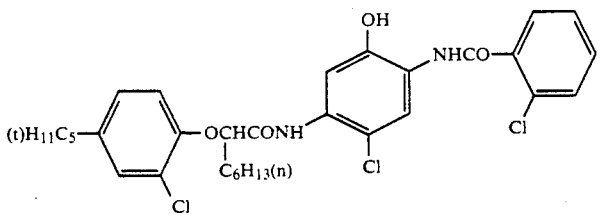
CI-7
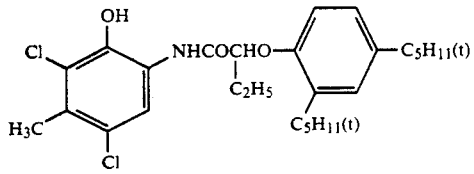
CI-8
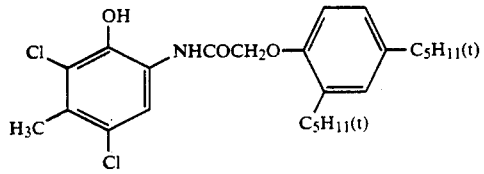
CI-9
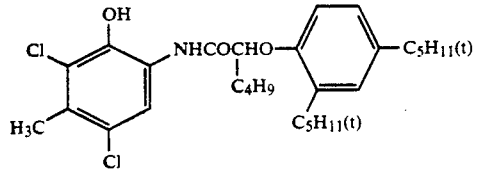
CI-10
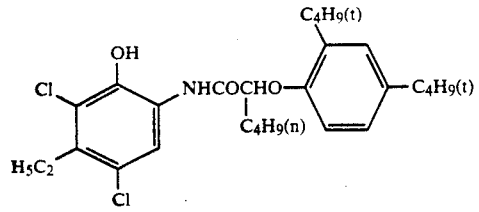
CI-11
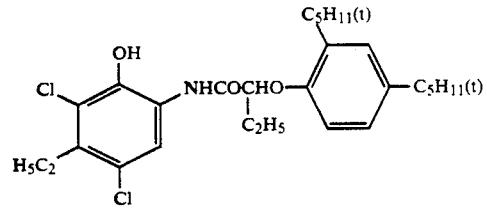
CI-12
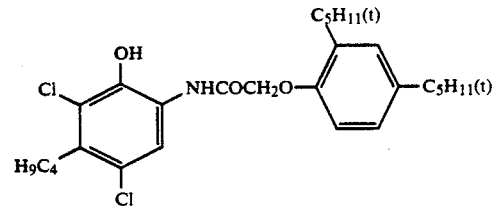
CI-13
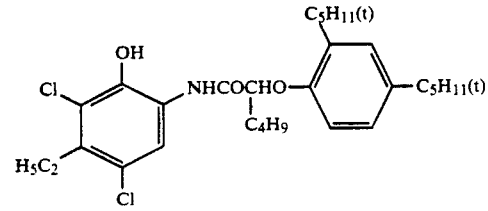

The dye forming couplers used in the present invention are normally used for individual silver halide emulsion layers at the range of $1\times10^{-3}$ mol to 1 mol, preferably $1\times10^{-2}$ mol to $8\times10^{-1}$ mol per mol of silver halide.

The binder (or protective colloid) used for the photosensitive silver halide photographic material of the invention is preferably gelatin. Besides it, various other hydrophilic colloids may be used including gelatin derivative, graft polymers of gelatin and other polymers, proteins, sugar derivatives, cellulose derivatives, and synthetic hydrophilic polymers such as homopolymers and copolymers.

The photosensitive material of the invention may contain other additives such as anti-turbidity agent, image stabilizer, UV absorber, plasticizer, latex, surfactant, matting agent, lubricant, and antistatic agent, wherever required.

The photosensitive material of the invention is subjected to a conventional color development processing well known in the art to form images.

Color developing agents used in the invention include aminophenolic and p-phenylenediamine derivatives that are widely used in various color photographic processes.

The color developing solution used in processing of the photosensitive material of the invention may contain, in addition to aforesaid primary aromatic amine color developing agent, any known developer components.

The pH value of a color developing solution is usually higher than 7, most commonly approximately 10 to 13.

The temperature of a color developing solution is normally not lower than 15° C., and commonly 20° C. to 50° C. Rapid processing is carried out preferably at not less than 30° C. Conventionally, processing time is 3 to 4 minutes. In the invention addressed to rapid processing, however, normal processing time for color development is preferably 20 to 60 second, more preferably 30 to 50 second.

The photosensitive material of the invention is subjected to bleaching and fixing after color development. Bleaching may be carried out simultaneously with fixing.

When bleaching and fixing are carried out simultaneously in the invention directed to rapid processing, pH of a bleach/fix solution is preferably lower than 6.5.

After fixing, washing is usually carried out. Washing may be replaced with stabilization, or both may be carried out in combination.

As explained so far, the photosensitive silver halide photographic material of the invention is suitable for rapid processing, provides excellent decolorization of dyes and good image quality, assures good aging stability of coating solution in course of manufacturing, and can be mass-produced stably.

EXAMPLES

The following examples will be given to explain the invention in further detail. It is to be understood that the scope of the invention is not limited by the examples.

EXAMPLE 1

The following silver chloride and bromochloride emulsions were prepared by a double jet method.

| Emulsion No. | Grain size (μm) | Silver Chloride Content (mol %) | Coefficient of Variation |
|---|---|---|---|
| Em-A | 0.5 | 20 | 0.12 |
| Em-B | 0.5 | 50 | 0.13 |
| Em-C | 0.5 | 90 | 0.11 |
| Em-D | 0.5 | 95 | 0.08 |
| Em-E | 0.5 | 99 | 0.09 |
| Em-F | 0.5 | 99.8 | 0.08 |
| Em-G | 0.5 | 100 | 0.08 |

Emulsion Em-A to G were subjected to conventional chemical sensitization by chloroaurate ($5\times10^{-5}$ mol/molAgX) and sodium thiosulfate (2 mg/molAgX), and then to spectral sensitization by a sensitizing dye (Expl No. C-9) to obtain red-sensitive silver halide emulsions EmR-A to G.

Em-F were subjected to conventional chemical sensitization by sodium thiosulfate alone, and then to spectral sensitization by a sensitizing dye (Expl No. C-9) to obtain a red-sensitive silver halide emulsion EmR-I.

On a polyethylene coated paper support were provided simultaneously the following first and second layers to prepare monocolor photosensitive samples 1-1 to 1-30. It is noted that the amounts of the compounds in the respective layers are shown in terms of coated amounts per 100 $cm^2$, provided that individual layers are single-coated.

First layer

A red-sensitive silver halide emulsion layer containing 3 mg of a red-sensitive silver halide emulsion (see Table 1) as silver, each 2 mg of cyan coupler CI-5 and CI-7, 3 mg of dioctylphthalate as a high boiling-point organic solvent, 0.15 mg of hydroquinone derivative HQ-1, 14 mg of gelatin, and 0 or 2 mg of a Compound [II] (see Table 1).

Second layer

A protective layer containing 0.1 mg of Compound [I](see Table 1) or 0.2 mg of a comparative dye (AI-1), 0.25 mg of polyvinylpyrrolidone (weight-average molecular weight 360,000) as a brightening agent scavenger, 20 mg of gelatin, and 0.1 mg of Hardener [III] or [IV] (see Table 1) or 0.2 mg of H-1 or 0.15 mg of H-2 as a comparative hardener.

Emulsion coating solutions were coated just after preparation and after aging at 40° C. for 3 hours and 6 hours.

Compound [I] may be added to the first layer in place of the second layer, of which result was shown in Sample 1-10.

Sample 1-22 was prepared in the same manner as Sample 1-14 except that polyvinyl pyrrolidone was not incorporated therein.

Emulsion J was prepared in the same way as EmR-F except that the following sensitizing dye A was used in place of the sensitizing dye Expl No. C-9, and Sample No 1-28 was prepared in the same manner as Sample 1-14 except that EmR-F was replaced by EmJ.

Then, Samples 1-29 and 1-30 were prepared in the same way as Sample 1-14 except that the following stabilizers W-1 and W-2 were used in place of SB-2 (Compound [II]) of the invention.

HQ-1

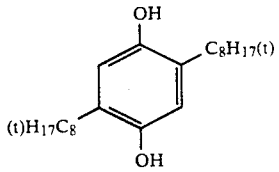

AI-1

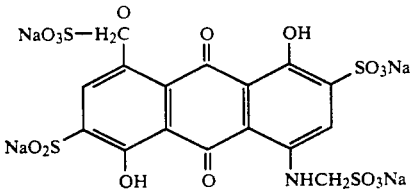

H-1

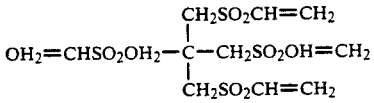

H-2

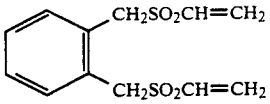

W-1

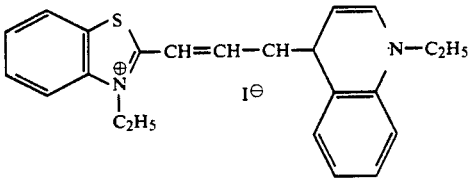

W-2

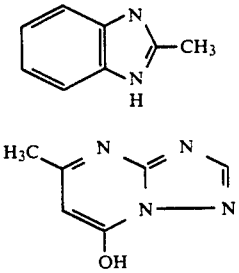

The individual samples were subjected to wedge exposure by a photosensitometer KS-7 (made by Knoica K. K.). Thereafter, the exposed and unexposed samples were subjected to the following processing.

| [Processing step] | Temperature | Time |
|---|---|---|
| Color development | 35.0 ± 0.3° C. | 45 sec |
| Bleach/fix | 35.0 ± 0.5° C. | 45 sec |
| Stabilization | 30–34° C. | 90 sec |
| Drying | 60–80° C. | 60 sec |

| (Color developing solution) | |
|---|---|
| Pure water | 800 ml |
| Triethanolamine | 10 g |
| N,N-diethylhydroxylamine | 5 g |
| Potassium bromide | 0.02 g |
| Potassium chloride | 2 g |
| Potassium sulfite | 0.3 g |
| 1-hydroxyethylidene-1,1-diphosphonic acid | 1.0 g |
| Ethylenediamine tetraacetic acid | 1.0 g |
| Catechol-3,5-disulfonic acid disodium salt | 1.0 g |

-continued

| | |
|---|---|
| N-ethyl-N-β-methane sulfonamide ethyl-3-methyl-4-aminoaniline sulfate | 4.5 g |
| Brightening agent (4,4'-diaminostilbene disulfonic acid derivative) | 1.0 g |
| Potassium carbonate | 27 g |

Water was added to make total quantity 1l, and pH was adjusted to 10.10 with potassium hydroxide or sulfuric acid. (Bleach/fix solution)

| | |
|---|---|
| Ferric ammonium ethylenediamine tetraacetate dihydrate | 60 g |
| Ethylenediamine tetraacetic acid | 3 g |
| Ammonium thiosulfate (70% aqueous solution) | 100 ml |
| Ammonium sulfite (40% aqueous solution) | 27.5 ml |

Water was added to make total quantity 1l, and pH was adjusted to 6.2 with potassium carbonate or glacial acetic acid.

| (Stabilizing solution) | |
|---|---|
| 5-chloro-2-methyl-4-isothiazolin-3-one | 1.0 g |
| Ethylene glycol | 1.0 g |
| 1-hydroxyethylidene-1,1-diphosphonic acid | 2.0 g |
| Ethylenediamine tetraacetic acid | 1.0 g |
| Ammonium hydroxide (20% water solution) | 3.0 g |
| Ammonium sulfite | 3.0 g |
| Brightening agent (4,4'-diaminostilbene disulfonic acid derivative) | 1.5 g |

Water was added to make total quantity 1l, and pH was adjusted to 7.0 with sulfuric acid or potassium hydroxide.

The following properties were evaluated for the individual samples.

(1) Sensitometry

Sensitivity, gradation and maximum density (Dmax) of the processed sample were measured by PDA-65 densitometer (made by Konica K. K.). It is noted that sensitivity is a value relative to that of Sample 1-1, which is set at 100; and gradation (γ) is shown in terms of gradient of a straight line drawn on density points 0.5 and 1.5 in a specific curve.

The sensitivities and gradation variations (γΔ) after aging of coating solutions are the values relative to those of the respective samples before aging, which are set at 100 and ±0, respectively.

(2) Fog

Individual unexposed samples were subjected to a prescribed processing, and reflection density was measured by 310TR made by X Light.

(3) Sharpness

A resolvability test chart was printed on each sample with red light, and then the sample was subjected to a prescribed processing. A density of a printed cyan image was measured by microphotometer, and sharpness was calculated from the following equation.

$$\text{Sharpness (\%)} \frac{\text{(max density} - \text{min density) on print at density of 5 lines/mm}}{\text{(max density} - \text{min density)}} \times 100$$

The greater the value, the higher the sharpness.

The results are shown in Table 1.

TABLE 1

| Sample No. | Emulsion Em R | Compound [I] | Layer Containing Compound [I] | Compound [II] | Hardener for Protective Layer | Sensitometry Relative Sensitivity | Dmax | Fog | Sharpness | Aging stability of Coating Solution (40° C.) Relative Sensitivity/Gradation Variation (Δγ) Aging 3 hr | Aging 6 hr | Remarks |
|---|---|---|---|---|---|---|---|---|---|---|---|---|
| 1-1 | A | AI-1 | 2nd layer | — | H-1 | 100 | 2.12 | 0.013 | 0.45 | 99/−0.04 | 97/−0.09 | Comp |
| 1-2 | B | AI-1 | 2nd layer | — | H-1 | 103 | 2.14 | 0.017 | 0.44 | 98/−0.07 | 96/−0.15 | Comp |
| 1-3 | C | AI-1 | 2nd layer | — | H-1 | 110 | 2.52 | 0.020 | 0.45 | 97/−0.13 | 95/−0.21 | Comp |
| 1-4 | D | AI-1 | 2nd layer | — | H-1 | 112 | 2.56 | 0.021 | 0.46 | 97/−0.15 | 95/−0.22 | Comp |
| 1-5 | E | AI-1 | 2nd layer | — | H-1 | 112 | 2.55 | 0.022 | 0.45 | 97/−0.15 | 94/−0.24 | Comp |
| 1-6 | F | AI-1 | 2nd layer | — | H-1 | 113 | 2.55 | 0.022 | 0.45 | 97/−0.16 | 95/−0.23 | Comp |
| 1-7 | G | AI-1 | 2nd layer | — | H-1 | 113 | 2.55 | 0.024 | 0.45 | 97/−0.17 | 95/−0.25 | Comp |
| 1-8 | F | Expl 47 | 2nd layer | — | H-1 | 115 | 2.55 | 0.024 | 0.53 | 96/−0.21 | 94/−0.32 | Comp |
| 1-9 | F | Expl 47 | 2nd layer | — | H-2 | 115 | 2.55 | 0.025 | 0.53 | 96/−0.21 | 94/−0.32 | Comp |
| 1-10 | F | Expl 47 | 1st layer | — | H-2 | 115 | 2.55 | 0.025 | 0.53 | 96/−0.26 | 94/−0.39 | Comp |
| 1-11 | F | Expl 47 | 2nd layer | — | III-1 | 115 | 2.55 | 0.016 | 0.53 | 96/−0.23 | 94/−0.35 | Comp |
| 1-12 | F | Expl 47 | 2nd layer | — | IV-9 | 115 | 2.55 | 0.017 | 0.53 | 96/−0.23 | 94/−0.36 | Comp |
| 1-13 | F | Expl 47 | 2nd layer | SC-19 | III-1 | 114 | 2.55 | 0.016 | 0.53 | 96/−0.11 | 94/−0.17 | Invention |
| 1-14 | F | Expl 47 | 2nd layer | SB-2 | III-1 | 115 | 2.55 | 0.015 | 0.53 | 96/−0.08 | 94/−0.14 | Invention |
| 1-15 | F | Expl 47 | 2nd layer | SB-5 | III-1 | 115 | 2.55 | 0.013 | 0.53 | 96/−0.06 | 94/−0.12 | Invention |
| 1-16 | F | — | — | SB-5 | III-1 | 203 | 2.56 | 0.011 | 0.29 | 97/−0.05 | 95/−0.12 | Comp |
| 1-17 | G | Expl 47 | 2nd layer | — | H-1 | 114 | 2.55 | 0.027 | 0.53 | 96/−0.24 | 94/−0.36 | Comp |
| 1-18 | G | Expl 47 | 2nd layer | — | III-1 | 114 | 2.54 | 0.017 | 0.53 | 96/−0.24 | 94/−0.38 | Comp |
| 1-19 | G | Expl 47 | 2nd layer | SB-5 | III-1 | 110 | 2.54 | 0.017 | 0.53 | 96/−0.13 | 94/−0.19 | Invention |
| 1-20 | I | Expl 47 | 2nd layer | — | H-1 | 112 | 2.54 | 0.023 | 0.53 | 96/−0.20 | 94/−0.34 | Comp |
| 1-21 | I | Expl 47 | 2nd layer | — | III-1 | 112 | 2.54 | 0.016 | 0.53 | 96/−0.22 | 94/−0.36 | Comp |
| 1-22 | I | Expl 47 | 2nd layer | SB-2 | III-1 | 109 | 2.53 | 0.015 | 0.53 | 96/−0.12 | 94/−0.19 | Invention |
| 1-23 | I | Expl 47 | 2nd layer | SB-5 | III-1 | 111 | 2.54 | 0.015 | 0.53 | 96/−0.11 | 94/−0.17 | Invention |
| 1-24 | E | Expl 57 | 2nd layer | — | H-1 | 116 | 2.55 | 0.023 | 0.53 | 96/−0.20 | 94/−0.31 | Comp |
| 1-25 | E | Expl 57 | 2nd layer | — | III-1 | 116 | 2.55 | 0.016 | 0.53 | 96/−0.22 | 94/−0.34 | Comp |
| 1-26 | E | Expl 57 | 2nd layer | SB-5 | III-1 | 116 | 2.55 | 0.013 | 0.53 | 97/−0.08 | 94/−0.14 | Invention |
| 1-27 | E | Expl 57 | 2nd layer | SB-5 | H-1 | 116 | 2.55 | 0.020 | 0.53 | 97/−0.07 | 94/−0.13 | Comp |
| 1-28 | J | Expl 47 | 2nd layer | SB-5 | III-1 | 112 | 2.54 | 0.015 | 0.53 | 96/−0.08 | 94/−0.15 | Invention |
| 1-29 | F | Expl 47 | 2nd layer | W-1 | III-1 | 115 | 2.55 | 0.015 | 0.53 | 96/−0.18 | 94/−0.31 | Comp |
| 1-30 | F | Expl 47 | 2nd layer | W-2 | III-1 | 115 | 2.55 | 0.014 | 0.53 | 96/−0.20 | 94/−0.32 | Comp |

As is apparent from Table 1, in Samples 1-1 and 1-2 containing comparative emulsions with low silver chloride content and comparative dyes, no satisfactory results were obtained in respect of sensitivity and maximum density. Samples 1-3 to 1-7 containing the emulsions with high silver chloride content showed some improvement in sensitivity and maximum density, while fog and sharpness were still unsatisfactory.

In Samples 1-8 to 1-15 and 1-17 to 1-30 containing Compound [I], sharpness was improved to a satisfactory level, but Samples 1-8 to 1-10, 1-17, 1-20, 1-24, and 1-27 hardened with comparative hardeners were found still insufficient in fog.

In Samples 1-1 to 1-12, 1-17, 1-18, 1-20, 1-21, 1-24, 1-25 containing no Compound [II], performance variation especially in gradation due to aging at regular temperature was unfavorably large. Such degradation in aging stability was accelerated further more by addition of Compound [I] to the first layer (emulsion layer) (Sample 1-10).

Meantime, in Samples 1-11 to 1-16, 1-18, 1-19, 1-21 to 23, 1-25, 1-26, and 1-28 to 1-30, all of which were hardened with Hardeners [III] and [IV] of the invention, fog was reduced with no degradation whatever in sensitometry performance and sharpness. However, the samples containing emulsions with high silver choloride content, Compound [I] and Hardener [III] or [IV] were not still improved in gradation variation due to aging of the coating solutions, and it was liable to become rather slightly larger by use of Hardener [III] or [IV].

On the other hand, in Samples 1-13 to 1-15, 1-19, 1-22, 1-23, 1-26 and 1-28 containing a mercapto Compound [II] of the invention, gradation variation due to aging was remarkably reduced without causing sensitivity change such as desensitization. Further, fog was reduced, too, without degrading sensitometry as well as sharpness.

Such improvement were more remarkably observed with the samples chemically sensitized by chlorauric acid in combination with sodium thiosulfate and containing a silver bromochloride emulsion with 0.2 Mol % silver bromide content.

The same effects were observed with Compound [I] of Nos. 48, 76''', 70, 73, 74, 76'', and 83.

EXAMPLE 2

Emulsions Em-A to G of Example 1 were subjected to chemical sensitization (chlorauric acid % sodium thiosulfate) in the same way as in Example 1, and further to spectral sensitization with a sensitizing dye (Expl B-11) to obtain the green-sensitive silver halide emulsions EmG-A to G.

The following first and second layers were simultaneously provided on a polyethylene coated support to prepare monocolor photosensitive samples 2-1 to 2-26. The amounts of the compounds in the respective layers are shown in terms of coated amounts per 100 $cm^2$, provided that each layer is single-coated.

First layer

Green-sensitive silver halide emulsion layer containing 4 mg of a green-sensitive silver halide emulsion (see Table 2) as silver, 4 mg of a magenta coupler (m-3), 3 mg of dioctylphthalate as a high boiling-point organic solvent, 0.15 mg of HQ-1, 14 mg of gelatin, and 0 and 2 mg of Compound [II] (see Table 2).

Second layer

Protective layer containing 0.1 mg of Compound [I] (see Table 2) or 0.1 mg of a comparative dye (A1-2), 0.25 mg of polyvinyl pyrrolidone as a brightening agent scavenger, 20 mg of gelatin, and 0.2 mg of Hardener [III] or [IV] (see Table 2), or 0.2 mg of H-1 or 0.15 mg of H-2 as comparative hardeners.

The coating solutions were coated just after preparation and after aging at 40° C. for 3 hours and 6 hours.

In Samples 2-12, 2-13, 2-18 and 2-20 to 2-22, Compound [I] was added to the first layer instead of the second layer.

An emulsion EmG-K was prepared in the same manner as EmG-F except that the following sensitizing dye Q was used instead of the sensitizing dye (Expl No. B-11), and Sample 2-27 was prepared in the same manner as Sample 2-17 except that EmG-F was replaced by EmG-K.

The individual samples were evaluated in the same manner as in Example 1, except that sharpness was evaluated for magenta images printed through a resolvability test chart with green light. Sensitivity of each sample is a value relative to that of Sample 2-1, which is set at 100.

Relative sensitivity and gradation variation ($\phi$) are as described in Example 1.

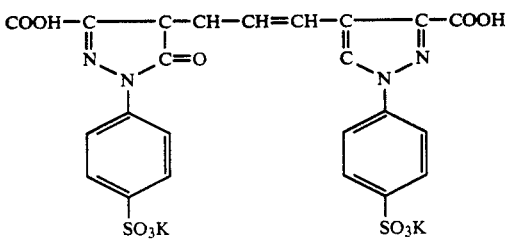

AI-2

-continued

Sensitizing dye Q

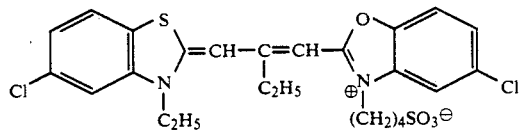

TABLE 2

| Sample No. | Emulsion Em G | Compound [I] | Layer Containing Compound [I] | Compound [II] | Hardener for Protective Layer | Sensitometry Relative Sensitivity | Sensitometry Dmax | Sensitometry Fog | Sharpness | Aging stability of Coating Solution (40° C.) Relative Sensitivity/Gradation Variation (Δγ) Aging 3 hr | Aging stability of Coating Solution (40° C.) Relative Sensitivity/Gradation Variation (Δγ) Aging 6 hr | Remarks |
|---|---|---|---|---|---|---|---|---|---|---|---|---|
| 2-1 | A | AI-2 | 2nd layer | — | H-2 | 100 | 2.26 | 0.011 | 0.58 | 100/−0.02 | 99/−0.06 | Comp |
| 2-2 | B | AI-2 | 2nd layer | — | H-2 | 102 | 2.29 | 0.015 | 0.59 | 99/−0.05 | 98/−0.13 | Comp |
| 2-3 | C | AI-2 | 2nd layer | — | H-2 | 105 | 2.37 | 0.018 | 0.58 | 99/−0.10 | 97/−0.18 | Comp |
| 2-4 | D | AI-2 | 2nd layer | — | H-2 | 107 | 2.39 | 0.019 | 0.60 | 99/−0.10 | 97/−0.25 | Comp |
| 2-5 | E | AI-2 | 2nd layer | — | H-2 | 108 | 2.40 | 0.019 | 0.60 | 98/−0.12 | 97/−0.23 | Comp |
| 2-6 | F | AI-2 | 2nd layer | — | H-2 | 108 | 2.41 | 0.019 | 0.60 | 98/−0.12 | 97/−0.25 | Comp |
| 2-7 | G | AI-2 | 2nd layer | — | H-2 | 108 | 2.40 | 0.020 | 0.60 | 98/−0.13 | 97/−0.25 | Comp |
| 2-8 | F | Expl 10 | 2nd layer | — | H-2 | 113 | 2.44 | 0.022 | 0.72 | 98/−0.18 | 96/−0.30 | Comp |
| 2-9 | F | Expl 10 | 2nd layer | — | H-1 | 113 | 2.44 | 0.021 | 0.72 | 98/−0.18 | 96/−0.29 | Comp |
| 2-10 | F | Expl 10 | 2nd layer | — | III-2 | 113 | 2.44 | 0.014 | 0.72 | 98/−0.18 | 96/−0.32 | Comp |
| 2-11 | F | Expl 10 | 2nd layer | — | IV-4 | 113 | 2.44 | 0.015 | 0.72 | 98/−0.18 | 96/−0.31 | Comp |
| 2-12 | F | Expl 10 | 1st layer | — | H-2 | 113 | 2.44 | 0.023 | 0.72 | 98/−0.20 | 96/−0.34 | Comp |
| 2-13 | F | Expl 10 | 1st layer | — | III-2 | 113 | 2.44 | 0.015 | 0.72 | 98/−0.21 | 96/−0.34 | Comp |
| 2-14 | F | — | — | — | III-2 | 181 | 2.45 | 0.013 | 0.37 | 98/−0.10 | 97/−0.21 | Comp |
| 2-15 | F | Expl 10 | 2nd layer | SC-36 | III-2 | 112 | 2.44 | 0.014 | 0.72 | 98/−0.06 | 97/−0.15 | Invention |
| 2-16 | F | Expl 10 | 2nd layer | SB-2 | III-2 | 112 | 2.44 | 0.013 | 0.72 | 98/−0.05 | 97/−0.09 | Invention |
| 2-17 | F | Expl 10 | 2nd layer | SB-5 | III-2 | 113 | 2.44 | 0.012 | 0.72 | 98/−0.03 | 97/−0.08 | Invention |
| 2-18 | F | Expl 10 | 1st layer | SB-5 | III-2 | 113 | 2.44 | 0.013 | 0.72 | 98/−0.07 | 97/−0.09 | Invention |
| 2-19 | F | — | — | SB-5 | III-2 | 181 | 2.45 | 0.012 | 0.37 | 98/−0.05 | 98/−0.07 | Comp |
| 2-20 | G | Expl 10 | 1st layer | — | H-1 | 113 | 2.43 | 0.023 | 0.72 | 98/−0.20 | 96/−0.33 | Comp |
| 2-21 | G | Expl 10 | 1st layer | — | III-2 | 113 | 2.43 | 0.016 | 0.72 | 98/−0.20 | 96/−0.35 | Comp |
| 2-22 | G | Expl 10 | 1st layer | SB-5 | III-2 | 113 | 2.43 | 0.016 | 0.72 | 98/−0.08 | 96/−0.14 | Invention |
| 2-23 | E | Expl 20 | 2nd layer | — | H-2 | 112 | 2.44 | 0.022 | 0.72 | 98/−0.19 | 96/−0.30 | Comp |
| 2-24 | E | Expl 20 | 2nd layer | — | III-2 | 112 | 2.44 | 0.014 | 0.72 | 98/−0.19 | 97/−0.33 | Comp |
| 2-25 | E | Expl 20 | 2nd layer | SB-5 | III-2 | 112 | 2.44 | 0.013 | 0.72 | 98/−0.05 | 97/−0.10 | Invention |
| 2-26 | E | Expl 20 | 2nd layer | SB-5 | H-2 | 112 | 2.44 | 0.022 | 0.72 | 98/−0.04 | 97/−0.09 | Comp |
| 2-27 | K | Expl 10 | 2nd layer | SB-5 | III-2 | 109 | 2.43 | 0.012 | 0.72 | 98/−0.05 | 97/−0.09 | Invention |

As is apparent from Table 2, the samples of the invention containing the emulsions with high silver chloride contents, Compound [I], Compound [11], and Hardener [III] or [IV] proved to provide the same satisfactory effects as the samples of the invention in Example 1.

The equivalent effects were also observed with Compounds [I] of Nos. 9, 18, 21, 25, 28, 30, 34, 39, and 44.

Also, in the samples prepared in the same manner as Example 2 except that first layer was replaced by the first layer (a blue-sensitive layer) in following Example 3, which contained 0.2 mg/dm$^2$ of Compound [I] of No. 2, 4, or 6 and 2.5 mg/dm$^2$ of Compound [II] of SB-5, and that the second layer (protective layer) contained 0.25 mg/dm$^2$ of polyvinyl pyrrolidone, 20 mg/dm$^2$ of gelatin and 0.1 mg/dm$^2$ of Hardener (III-1) the same effects as Examples 1 and 2 were observed.

EXAMPLE 3

The following silver bromochloride emulsion was prepared in the same manner as in Example 1.

| Emulsion No. | Grain Size (m) | Silver Chloride Cont. (mol %) | Variation Coefficient |
|---|---|---|---|
| H | 0.8 | 99.7 | 0.07 |

Emulsions Em-E and Em-F prepared in Example 1 and emulsion Em-H prepared as above were provided with chloroaurate of $5\times10^{-5}$ mol per mol of silver halide, and then were subjected to chemical sensitization by adding 2 mg of sodium thiosulfate per mol of silver halide. Thereafter, Em-E subjected to gold sulfur sensitization was subjected to spectral sensitization with a sensitizing dye (Expl No. D-3'). Similarly, Em-F was subjected to spectral sensitization with a sensitizing dye (Expl No. B-4), and Em-H with a sensitizing dye (SD-A shown below). Thus, a red-sensitive silver halide emulsion EmR No. E2, a green-sensitive silver halide emulsion EmG No. F2, and a blue-sensitive silver halide emulsion EmB No. H were prepared respectively. The following coating solutions containing the preceding emulsions were simultaneously coated in layers on a support of a polyethylene coated paper to prepare a multicolor photosensitive silver halide photographic material.

The amounts of the compounds in the respective layers is shown in terms of the coated amounts provided that each layer is single-coated.

First layer

A blue-sensitive emulsion layer containing 8 mg/dm$^2$ of yellow coupler (Y-8), 3 mg/dm$^2$ of a blue-sensitive emulsion EmB No. H as silver, 3mg/dm$^2$ of high boiling-point solvent (S-1), 2.5mg/dm$^2$ of Compound [II] (see Table 3 ), and 16 mg/dm$^2$ of gelatin.

Second layer

An intermediate layer containing 0.45 mg/dm$^2$ of hydroquinone derivative (HQ-1) and 4 mg/dm$^2$ of gelatin.

Third layer

A green-sensitive emulsion layer containing 4 mg/dm$^2$ of magenta coupler (m-3), 0.1 mg/dm$^2$ of a dye shown in Table 3, 3 mg/dm$^2$ of a green-sensitive emulsion (EmG No. F2) as silver, 4 mg/dm$^2$ of a high boiling-point organic solvent (S-2), 2 mg/dm$^2$ of Compound [II] (see Table 3), and 16 mg/dm$^2$ of gelatin.

Fourth layer

An intermediate layer containing each 3 mg/dm$^2$ of UV absorbers (UV-1) and (UV-2), 4 mg/dm$^2$ of a high boiling-point organic solvent (S-1), 0.45 mg/dm$^2$ of hydroquinone derivative(HQ-1), and 14 mg/dm$^2$ of gelatin.

Fifth layer

A red-sensitive emulsion layer containing each 2 mg/dm$^2$ of cyan couplers (C1-7) and (C1-5), 2 mg/dm$^2$ of a high boiling-point organic solvent (S-2), 2 mg/dm$^2$ of a red-sensitive emulsion (EmR No. E2) as silver, each 0.1 mg/dm$^2$ of dyes shown in Table 3 except 0.2 mg/dm$^2$ of dye AI-1, 2 mg/dm$^2$ of Compound [II] (shown in Table 3), and 14 mg/dm$^2$ of gelatin.

Sixth layer

An intermediate layer containing each 2 mg/dm$^2$ of UV absorbers (UV-1) and (UV-2), 0.2 mg/dm$^2$ of polyvinyl pyrrolidone, 2 mg/dm$^2$ of high boiling-point organic solvent (S-1), and 6 mg/dm$^2$ of gelatin.

Seventh layer

A protective layer containing 1.0 mg/dm$^2$ of Hardener [III] or [IV] (shown in Table 3), 2.0 mg/dm$^2$ and 1.5 mg/dm$^2$ of comparative hardeners H-1 and H-2, respectively, and 9 mg/dm$^2$ of gelation.

In the above layer arrangement, Compound [I] added to the third and fifth layers was changed to prepare Samples 3-1 to 3-30, Compound [I] of the invention were added also to the second, fourth, sixth and seventh layers as well as the preceding layers.

The prepared samples were processed and evaluated in the exactly same way as in Examples 1 and 2. The results are shown in Table 3 (1) and 3 (2). The sensitivities of the individual sensitive layers in Table 3 (1) are the values relative to those of Sample No. 3-1, which are set at 100, respectively, and the sensitivities of the individual sensitive layers after aging for 3 hours and 6 hours in Table 3 (2) are the values relative to those of the individual layers before aging, which are set at 100, respectively.

Of the dyes used in third and fifth layers shown in Table 3, A1-1 and A1-2 are shown in Examples 1 and 2. As follows are shown high boiling-point organic solvents (S-1) and (S-2), UV absorbers (UV-1) and (UV-2), and sensitizing dye (SD-A).

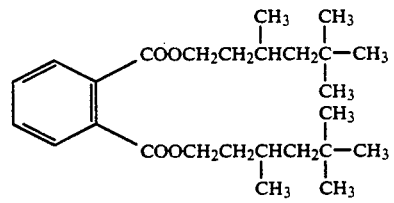

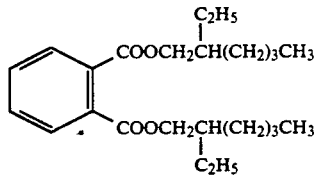

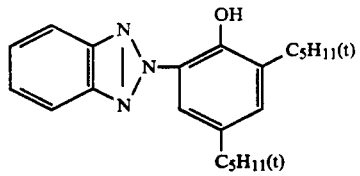

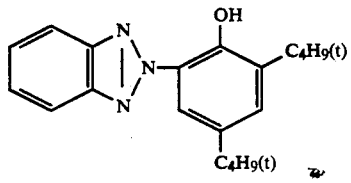

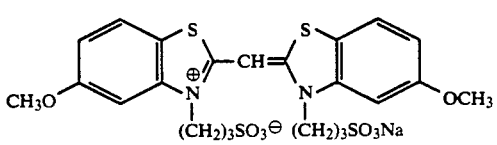

TABLE 3

| Compound [I] | Compound [I] | Compound [I] in 2nd, 4th, | Hardener for |
|---|---|---|---|

TABLE 3-continued

| Sample No. | in 3rd Layer | in 5th Layer | 6th or 7th Layer Type | 6th or 7th Layer Layer | Compound II 1st Layer | Compound II 3rd Layer | Compound II 5th Layer | Protective Layer |
|---|---|---|---|---|---|---|---|---|
| 3-1 | AI-2 | AI-1 | — | — | — | — | — | H-1 |
| 2 | Expl 10 | Expl 48 | — | — | — | — | — | H-1 |
| 3 | Expl 10 | Expl 48 | — | — | — | — | — | III-1 |
| 4 | Expl 10 | Expl 48 | — | — | SB-5 | — | — | III-1 |
| 5 | Expl 10 | Expl 48 | — | — | SB-5 | SB-5 | — | III-1 |
| 6 | Expl 10 | Expl 48 | — | — | SB-5 | SB-5 | SB-5 | III-1 |
| 7 | Expl 10 | — | Expl 48 | 6th layer | SB-5 | SB-5 | SB-5 | III-1 |
| 8 | Expl 10 | — | Expl 48 | 7th layer | SB-5 | SB-5 | SB-5 | III-1 |
| 9 | — | Expl 48 | Expl 10 | 2nd layer | SB-5 | SB-5 | SB-5 | III-1 |
| 10 | Expl 10 | Expl 48 | — | — | SB-1 (1.5 mg) SB-5 (1 mg) | SB-5 | SB-5 | III-1 |
| 11 | Expl 10 | Expl 48 | — | — | SB-1 (1.5 mg) SB-5 (1 mg) | SB-5 | SB-5 | H-1 |
| 12 | Expl 20 | Expl 75 | — | — | — | — | — | H-2 |
| 13 | Expl 20 | Expl 75 | — | — | — | — | — | III-1 |
| 14 | Expl 20 | Expl 75 | — | — | — | — | SB-2 | III-1 |
| 15 | Expl 20 | Expl 75 | — | — | — | SB-1 (1.5 mg) SB-5 (1 mg) | SB-2 | III-1 |
| 16 | Expl 20 | Expl 75 | — | — | SB-5 | SB-1 (1.5 mg) SB-5 (1 mg) | SB-2 | III-1 |
| 17 | Expl 20 | — | Expl 73 | 6th layer | SB-5 | SB-1 (1.5 mg) SB-5 (1 mg) | SB-2 | III-1 |
| 18 | Expl 20 | — | Expl 73 | 6th layer | SB-5 | SB-1 (1.5 mg) SB-5 (1 mg) | SB-2 | H-2 |
| 19 | Expl 19 | Expl 60 | — | — | — | — | — | III-1 |
| 20 | Expl 19 | Expl 60 | — | — | SB-5 | SB-5 | SB-2 | III-1 |
| 21 | Expl 21 | Expl 77 | — | — | — | — | — | III-1 |
| 22 | Expl 21 | Expl 77 | — | — | SB-5 | SB-5 | SB-5 | III-1 |
| 23 | Expl 25' | Expl 76" | — | — | — | — | — | IV-9 |
| 24 | Expl 25' | Expl 76" | — | — | SB-5 | SB-5 | SB-5 | IV-9 |
| 25 | Expl 39' | Expl 74 | — | — | — | — | — | III-1 |
| 26 | Expl 39' | Expl 74 | — | — | SB-5 | SB-5 | SB-5 | III-1 |
| 27 | Expl 34 | Expl 83 | — | — | — | — | — | III-1 |
| 28 | Expl 34 | Expl 83 | — | — | SB-5 | SB-5 | SB-5 | III-1 |
| 29 | — | Expl 83 | Expl 34 | 4th layer | SB-5 | SB-5 | SB-5 | III-1 |
| 30 | Expl 34 | — | Expl 83 | 6th layer | SB-5 | SB-5 | SB-5 | III-1 |

| Sample No. | Relative Sensitivity B | Relative Sensitivity G | Relative Sensitivity R | Fog B | Fog G | Fog R | Sharpness G | Sharpness R | Aging Stability of Coating Solution Relative Sensitivity/Gradation Variation (Δγ) 40° C. Aging 3 hr B | Aging 3 hr G | Aging 3 hr R | Aging 6 hr B | Aging 6 hr G | Aging 6 hr R | Remarks |
|---|---|---|---|---|---|---|---|---|---|---|---|---|---|---|---|
| 3-1 | 100 | 100 | 100 | 0.016 | 0.018 | 0.020 | 0.60 | 0.45 | 97/−0.16 | 98/−0.12 | 97/−0.14 | 95/−0.24 | 97/−0.22 | 95/−0.22 | Comp |
| 2 | 100 | 100 | 103 | 0.017 | 0.020 | 0.023 | 0.72 | 0.53 | 97/−0.16 | 98/−0.17 | 96/−0.20 | 95/−0.29 | 96/−0.28 | 94/−0.31 | Comp |
| 3 | 100 | 100 | 103 | 0.011 | 0.012 | 0.014 | 0.72 | 0.53 | 97/−0.18 | 98/−0.18 | 96/−0.20 | 95/−0.31 | 96/−0.30 | 94/−0.33 | Comp |
| 4 | 100 | 100 | 103 | 0.009 | 0.012 | 0.014 | 0.72 | 0.53 | 97/−0.10 | 98/−0.18 | 96/−0.19 | 95/−0.17 | 96/−0.30 | 94/−0.32 | Invention |
| 5 | 100 | 100 | 103 | 0.009 | 0.011 | 0.014 | 0.72 | 0.53 | 97/−0.09 | 98/−0.11 | 96/−0.20 | 95/−0.17 | 96/−0.15 | 94/−0.32 | Invention |
| 6 | 100 | 100 | 103 | 0.009 | 0.011 | 0.012 | 0.72 | 0.53 | 97/−0.09 | 98/−0.10 | 96/−0.08 | 95/−0.16 | 96/−0.15 | 94/−0.17 | Invention |
| 7 | 100 | 100 | 103 | 0.009 | 0.011 | 0.012 | 0.72 | 0.53 | 97/−0.09 | 98/−0.10 | 96/−0.06 | 95/−0.17 | 96/−0.15 | 94/−0.16 | Invention |
| 8 | 100 | 100 | 103 | 0.009 | 0.011 | 0.011 | 0.72 | 0.53 | 97/−0.09 | 98/−0.09 | 96/−0.06 | 95/−0.17 | 96/−0.13 | 94/−0.17 | Invention |
| 9 | 100 | 100 | 103 | 0.009 | 0.011 | 0.011 | 0.72 | 0.53 | 97/−0.09 | 98/−0.09 | 96/−0.06 | 95/−0.17 | 96/−0.11 | 94/−0.17 | Invention |
| 10 | 101 | 100 | 103 | 0.008 | 0.011 | 0.011 | 0.72 | 0.53 | 97/−0.08 | 98/−0.10 | 96/−0.08 | 95/−0.16 | 96/−0.14 | 94/−0.16 | Invention |
| 11 | 101 | 100 | 103 | 0.016 | 0.017 | 0.021 | 0.72 | 0.53 | 97/−0.08 | 98/−0.08 | 96/−0.07 | 95/−0.15 | 96/−0.16 | 94/−0.15 | Comp |
| 12 | 100 | 101 | 104 | 0.017 | 0.021 | 0.022 | 0.72 | 0.52 | 97/−0.17 | 98/−0.17 | 96/−0.21 | 95/−0.27 | 97/−0.28 | 94/−0.32 | Comp |
| 13 | 100 | 101 | 104 | 0.010 | 0.012 | 0.012 | 0.72 | 0.52 | 97/−0.19 | 98/−0.17 | 96/−0.22 | 95/−0.30 | 96/−0.29 | 94/−0.34 | Comp |
| 14 | 100 | 101 | 104 | 0.010 | 0.012 | 0.010 | 0.72 | 0.52 | 97/−0.18 | 98/−0.17 | 96/−0.09 | 95/−0.30 | 96/−0.28 | 94/−0.16 | Invention |
| 15 | 100 | 101 | 104 | 0.010 | 0.010 | 0.010 | 0.72 | 0.52 | 97/−0.17 | 98/−0.08 | 96/−0.08 | 95/−0.30 | 96/−0.14 | 94/−0.16 | Invention |
| 16 | 100 | 101 | 104 | 0.009 | 0.010 | 0.010 | 0.72 | 0.52 | 97/−0.08 | 98/−0.08 | 96/−0.08 | 95/−0.16 | 96/−0.14 | 94/−0.17 | Invention |
| 17 | 100 | 101 | 104 | 0.009 | 0.010 | 0.010 | 0.72 | 0.52 | 97/−0.08 | 98/−0.08 | 96/−0.05 | 95/−0.16 | 96/−0.14 | 94/−0.15 | Invention |
| 18 | 100 | 101 | 104 | 0.016 | 0.019 | 0.021 | 0.72 | 0.52 | 97/−0.06 | 98/−0.07 | 96/−0.06 | 95/−0.14 | 96/−0.12 | 94/−0.15 | Comp |
| 19 | 100 | 100 | 103 | 0.010 | 0.011 | 0.013 | 0.71 | 0.52 | 97/−0.17 | 98/−0.16 | 96/−0.21 | 95/−0.32 | 96/−0.30 | 94/−0.34 | Comp |
| 20 | 100 | 100 | 103 | 0.008 | 0.010 | 0.012 | 0.71 | 0.52 | 97/−0.09 | 98/−0.10 | 96/−0.11 | 95/−0.18 | 96/−0.16 | 94/−0.17 | Invention |
| 21 | 100 | 100 | 104 | 0.011 | 0.011 | 0.012 | 0.72 | 0.53 | 97/−0.16 | 98/−0.16 | 96/−0.20 | 95/−0.31 | 96/−0.29 | 94/−0.33 | Comp |
| 22 | 100 | 100 | 104 | 0.010 | 0.010 | 0.010 | 0.72 | 0.53 | 97/−0.08 | 98/−0.08 | 96/−0.07 | 95/−0.15 | 96/−0.14 | 94/−0.15 | Invention |
| 23 | 100 | 99 | 103 | 0.011 | 0.013 | 0.014 | 0.72 | 0.53 | 97/−0.18 | 98/−0.16 | 96/−0.20 | 95/−0.33 | 96/−0.30 | 94/−0.35 | Comp |
| 24 | 100 | 99 | 103 | 0.010 | 0.011 | 0.012 | 0.72 | 0.53 | 97/−0.10 | 98/−0.09 | 96/−0.09 | 95/−0.18 | 96/−0.17 | 94/−0.18 | Invention |
| 25 | 100 | 100 | 104 | 0.011 | 0.014 | 0.014 | 0.72 | 0.53 | 97/−0.19 | 98/−0.17 | 96/−0.21 | 95/−0.34 | 98/−0.32 | 94/−0.35 | Comp |
| 26 | 100 | 100 | 104 | 0.009 | 0.011 | 0.013 | 0.72 | 0.53 | 97/−0.09 | 98/−0.10 | 96/−0.09 | 95/−0.17 | 98/−0.16 | 94/−0.17 | Invention |
| 27 | 100 | 100 | 103 | 0.011 | 0.013 | 0.014 | 0.72 | 0.53 | 97/−0.19 | 98/−0.18 | 96/−0.22 | 95/−0.32 | 98/−0.31 | 94/−0.34 | Comp |
| 28 | 100 | 100 | 103 | 0.010 | 0.012 | 0.012 | 0.72 | 0.53 | 97/−0.09 | 98/−0.07 | 96/−0.09 | 95/−0.16 | 98/−0.15 | 94/−0.18 | Invention |
| 29 | 100 | 100 | 103 | 0.010 | 0.011 | 0.012 | 0.72 | 0.53 | 97/−0.09 | 98/−0.06 | 96/−0.10 | 95/−0.17 | 98/−0.12 | 94/−0.18 | Invention |
| 30 | 100 | 100 | 103 | 0.010 | 0.012 | 0.011 | 0.72 | 0.53 | 97/−0.09 | 98/−0.08 | 96/−0.07 | 95/−0.17 | 98/−0.14 | 94/−0.15 | Invention |

As can be clearly seen from Table 3, the multi layered samples of the invention, Sample Nos. 3-4 to 3-10, 3-14 to 3-17, 3-20, 3-22, 2-24, 3-26, and 3-28 to 3-30, provide more improved properties in all aspects of sensitometry, fog, sharpness and property variations due to aging of coating solutions than the comparative samples.

EXAMPLE 4

Sample Nos. 4-1 to 4-16 were prepared in the same way as in Example 3, except that in Sample No. 3-6 prepared in Example 3, yellow coupler in the first layer, magenta coupler in the third layer, and cyan coupler in the fifth layer were replaced with the couplers of equivalent moles, respectively, as shown in Table 4

TABLE 4

| Sample. No. | Yellow Coupler in 1st Layer | Magenta Coupler in 3rd Layer | Cyan Coupler in 5th Layer |
|---|---|---|---|
| 4-1 | Y-2 | m-1 | CI-6/CI-7 |
| 4-2 | Y-2 | m-3 | CI-6/CI-7 |
| 4-3 | Y-2 | m-5 | CI-6/CI-7 |
| 4-4 | Y-2 | m-12 | CI-6/CI-7 |
| 4-5 | Y-2 | m-14 | CI-6/CI-7 |
| 4-6 | Y-2 | m-18 | CI-6/CI-7 |
| 4-7 | Y-4 | m-1 | CI-6/CI-7 |
| 4-8 | Y-4 | m-1 | CI-5/CI-7 |
| 4-9 | Y-4 | m-1 | CI-10 |
| 4-10 | Y-4 | m-5 | CI-10 |
| 4-11 | Y-6 | m-3 | CI-11 |
| 4-12 | Y-6 | m-4 | CI-11 |
| 4-13 | Y-6 | m-12 | CI-11 |
| 4-14 | Y-5 | m-3 | CI-5/CI-7 |
| 4-15 | Y-8 | m-12 | CI-5/CI-7 |
| 4-16 | Y-8 | m-14 | CI-5/CI-7 |

*Mixture ratio of CI-5/CI-7 is 1:1 in molar ratio.

Sample Nos. 4-1 to 4-16 were processed and evaluated in the same way as in Example 3. It was observed that the photosensitive materials of the invention where the couplers were replaced with the different ones provided the effects of the invention equivalent to those of the preceding examples.

What is claimed is:

1. A photosensitive silver halide photographic material having a support and provided thereon, photographic component layers, wherein at least one silver halide emulsion layer included in said photographic component layers comprises silver halide grains having silver chloride content of not less than 90 mol %; at least one of said photographic component layers comprises Compound [I] represented by Formula [I]; at least one silver halide emulsion layer included in said photographic component layers comprises Compound [II] represented by Formula [II]; and said photographic material comprises a photographic component layer hardened with at least one of Hardeners [III] and [IV] represented by Formula [III] and [IV ], respectively;

Formula [I ]

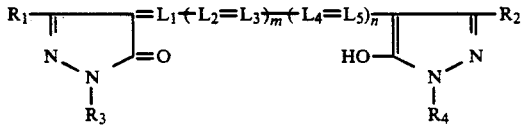

wherein $R_1$ and $R_2$ represent independently —C-N—,—$CFR_5R_6$, —$COR_7$ and —$CONHR_8$; $R_5$ and $R_6$ represent independently a hydrogen atom, a fluorine atom and a fluoroalkyl group having 1 to 4 carbon atoms; $R_7$ represents one selected from the group consisting of an alkyl group and an aryl group; $R_8$ represents one selected from the group consisting of a hydrogen atom, a halogen atom, an alkyl group and a fluoroalkyl group; $R_3$ and $R_4$ represent independently a hydrogen atom, an aliphatic group, an alicyclic group, an aromatic group and a hetrocyclic group; $L_1$ to $L_5$ represent a methine group; m and n represent independently 0 and 1;

Formula [II]

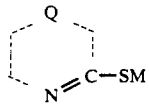

wherein Q represents a group of the atoms necessary to form a 5 or 6-membered hetrocyclic ring including one condensed with a benzene ring; M represents one selected iron the group consisting of a hydrogen atom and a cation;

Formula [II]

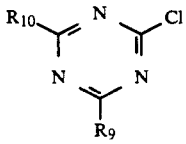

wherein $R_9$ and $R_{10}$ represent independently a chlorine atom, a hydroxyl group, an alkyl group, an alkoxy group, an alkylthio group, —OM', —$NR_{11}R_{12}$ and —$NHCOR_{13}$, provided that one of $R_9$ and $R_{10}$ represents a group other than a chlorine atom; M' represents a monovalent metallic atom; $R_{11}$ and $R_{12}$ represent independently a hydrogen atom, an alkyl group and an aryl group; $R_{13}$ represents one selected from the group consisting of a hydrogen group, an alkyl group and an aryl group;

Formula [IV]

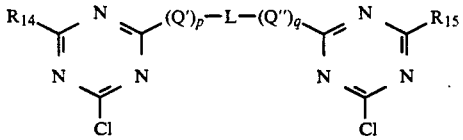

wherein $R_{14}$ and $R_{15}$ represent independently a chlorine atom, a hydroxy group, an alkyl group, an alkoxy group and —OM'; Q' and Q'' represent independently —O—, —S— and —NH—; M' represents a monovalent metallic atom; L represents one selected from the group consisting of an alkylene group and an arylene group; p and q represent independently 0 and 1.

2. The material of claim 1, wherein $R_1$ and $R_2$ represent independently —CN, —$CF_3$, —$COHN_2$ or —$COR_7$.

3. The material of claim 2, wherein $R_7$ is an alkyl group.

4. The material of claim 1, wherein $R_3$ and $R_4$ represent independently an aromatic group or a hetrocyclic group.

5. The material of claim 4, wherein the aromatic group is a 4-sulfopheny group or a 2,5-disulfophenyl group.

6. The material of claim 4, wherein the heterocyclic group is a benzothiazolyl group or a benzoxazole group.

7. The material of claim 1, wherein said methine group is substituted with a group selected from an alkyl group having 1 to 4 carbon atoms, and an aryl group.

8. The material of claim 1, wherein Compound [I] comprises at least one hydrophilic group.

9. The material of claim 8, wherein said at least one hydrophilic group is a sulfo group or a carboxyl group.

10. The material of claim 1, wherein said photographic material comprises the photographic component layers including a blue sensitive silver halide emulsion layer, a green-sensitive silver halide emulsion layer and a red-sensitive silver halide emulsion layer.

11. The material of claim 10, wherein Compound [I] with m=0 and n=0 is incorporated into the blue-sensitive emulsion layer; Compound [I] with m=1 and n=0 is incorporated into the green-sensitive emulsion layer; and Compound [I] with m=1 and n=1 is incorporated into the red-sensitive emulsion layer.

12. The material of claim 1, wherein m and n are 1 and 0 or 1 and 1, respectively.

13. The material of claim 12, wherein both of m and n are 1.

14. The material of claim 13, wherein Compound [I] with m=1 and n=1 is incorporated at least into the red-sensitive emulsion layer.

15. The material of claim 1, wherein the heterocyclic ring formed by Q is an imidazole ring, a tetrazole ring, a thiazole ring, an oxazole ring, a selenazole ring, a benzoimidazole ring, a napthoimidazole ring, a benzothiazole ring, a napthothiazole ring, a benzoselenazole ring, a napthoselenazole ring, or a benzoxazole ring.

16. The material of claim 1, wherein Compound [II] is represented by Formula [SA], [SB], [SC] or [SD];

Formula [SA]

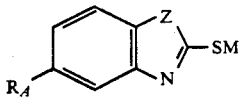

wherein $R_A$ represents a hydrogen atom, a halogen atom, an alkyl group, an alkoxy group, an aryl group, a carboxyl group or its salt, a sulfo group or its salt, or an amino group; Z represents —NH—, —O— or —S—; M represents a hydrogen atom, an alkaline metal atom or an ammonium group;

Formula [SB]

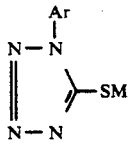

wherein Ar represents

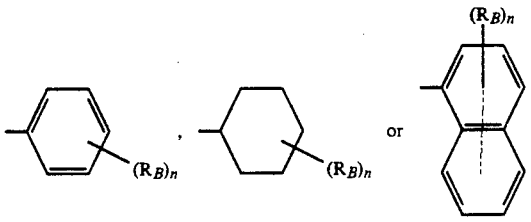

$R_B$ represents an alkyl group, an alkoxy group, a carboxyl group or its salt, a sulfo group or its salt, a hydroxyl group, an amino group, an acylamino group, a carbamoyl group, or a sulfonamide group n represents an integer of 0, 1 or 2; M represents a hydrogen atom, an alkaline metal atom or an ammonium group;

Formula [SC]

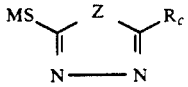

wherein Z represents

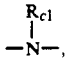

an oxygen atom or a sulfur atom; $R_c$ represents a hydrogen atom, an alkyl group, an aryl group, an alkenyl group, a cycloalkyl group, $—SR_{C2}$, $—NR_{C3}R_{C4}$, $—NHCOR_{C5}$, $—NHSO_2R_{C6}$, or a heterocyclic ring; $R_{C2}$ represents a hydrogen atom, an alkyl group, an alkenyl group, a cycloalkyl group, an aryl group, $—COR_{C5}$, or $—SO_2R_{C6}$; $R_{C3}$ and $R_{C4}$ represent independently a hydrogen atom, an alkyl group or an aryl group; $R_{C5}$ and $R_{C6}$ represent independently an alkyl group or an aryl group; M represents the same atom and groups as those defined in Formula [SA];

Formula [SD]

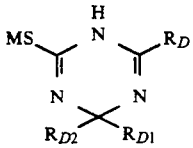

wherein $R_D$ and M represent the same atom and groups as those of $R_C$ and M in Formula SC], respectively; $R_{D1}$ and $R_{D2}$ represent the same atom and groups as those of $R_{C2}$ and $R_{C3}$ in Formula [SC].

17. The material of claim 16, wherein Compound [II] is represented by Formula [SB].

18. The material of claim 17, wherein Ar is a phenyl group including a substituted one.

19. The material of claim 18, wherein n is the integer of 1 or 2.

20. The material of claim 1, wherein a ratio of said silver halide grains having the silver chloride content of not less than 90 mol % is not less than 60 weight % of total silver halide grains contained in said at east one silver halide emulsion layer.

21. The material of claim 20, wherein said ratio is not less 80 weight %.

22. The material of claim 20, wherein said silver chloride content is not less than 95 mol %.

23. The material of claim 20, wherein a grain size of the silver halide grains is 0.2 to 1.6 μm.

24. The material of claim 23, wherein the grain size is 0.25 to 1.2 μm.

25. The material of claim 11, wherein an addition rate of Compound [I] is 0.01 to 1.0 mg per $dm^2$ of the photographic material.

26. The material of claim 25, wherein the addition rate is 0.03 to 0.4 mg per $dm^2$ of the photographic material.

27. The material of claim 16, wherein an addition rate of Compound [II] is $1\times10^{-8}$ to $1\times10^{-1}$ mol per mol of silver halide.

28. The material of claim 27, wherein the addition rate is $1\times10^{-5}$ to $1\times10^{-2}$ mol per mol of silver halide.

29. The material of claim 1, wherein an addition rate of Compound [III] or [IV] is 1 to 100 mg per gram of gelatin.

30. The material of claim 29, wherein the addition rate is 5 to 50 mg per gram of gelatin.

* * * * *